US010353309B2

(12) United States Patent
Sugama et al.

(10) Patent No.: US 10,353,309 B2
(45) **Date of Patent: *Jul. 16, 2019**

(54) ELECTROSTATIC IMAGE DEVELOPING TONER

(71) Applicant: Konica Minolta, Inc., Tokyo (JP)

(72) Inventors: Kouji Sugama, Musashino (JP); Hiroshi Nagasawa, Hachioji (JP); Anju Hori, Hachioji (JP); Noboru Ueda, Mitaka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/133,027

(22) Filed: Sep. 17, 2018

(65) Prior Publication Data

US 2019/0018329 A1 Jan. 17, 2019

Related U.S. Application Data

(63) Continuation of application No. 15/170,441, filed on Jun. 1, 2016, now Pat. No. 10,133,200.

(51) Int. Cl.
*G03G 9/087* (2006.01)

(52) U.S. Cl.
CPC ..... *G03G 9/08728* (2013.01); *G03G 9/08711* (2013.01); *G03G 9/08755* (2013.01); *G03G 9/08795* (2013.01); *G03G 9/08797* (2013.01)

(58) Field of Classification Search
CPC ..... G03G 9/018755; G03G 9/08708
See application file for complete search history.

(56) References Cited

U.S. PATENT DOCUMENTS

2013/0157190 A1* 6/2013 Kimura ..... C07D 239/60
430/108.15
2015/0056549 A1* 2/2015 Ikeda ..... G03G 9/08755
430/108.22

FOREIGN PATENT DOCUMENTS

JP 2006251564 A 9/2006
JP 2013195700 A 9/2013
JP 2015064566 A 4/2015

OTHER PUBLICATIONS

Notification of Reasons for Refusal dated May 23, 2017 from corresponding Japanese Patent Application No. 2015-121631 and English translation; 8 pages.

* cited by examiner

*Primary Examiner* — Peter L Vajda
(74) *Attorney, Agent, or Firm* — Lucas & Mercanti, LLP

(57) ABSTRACT

Provided is an electrostatic image developing toner comprising a toner base particle containing a binder resin and a releasing agent, wherein the binder resin comprises an amorphous vinyl resin and a crystalline polyester resin; a weight-average molecular weight of the electrostatic image developing toner is in the range of 50000 to 90000, when calculated from a chromatogram which represents a molecular weight distribution and is measured by gel permeation chromatography; a ratio of content of a resin component having a molecular weight of 100000 or more is in the range of 10 to 20% by area, in the chromatogram which represents the molecular weight distribution; the crystalline polyester resin has a melting point in the range of 65 to 85° C.; and, a ratio of content of the crystalline polyester resin in the binder resin is in the range of 5 to 20% by mass.

11 Claims, No Drawings

ELECTROSTATIC IMAGE DEVELOPING TONER

CROSS REFERENCE TO RELATED APPLICATION

This application is a continuation of U.S. Ser. No. 15/170,441 filed Jun. 1, 2016 which claimed the priority of Japanese Patent Application No. 2015-121631 filed on Jun. 17, 2015, the entire content of both applications are hereby incorporated by reference.

BACKGROUND OF THE INVENTION

Field of the Invention

The present invention relates to an electrostatic image developing toner. More specifically, the present invention relates to an electrostatic image developing toner excellent in low-temperature fixing property and low glossiness.

Description of the Related Art

For the purpose of coping with a faster speed of printing, expansion of paper types, or reduction of environmental impact in recent years, it has been required to reduce heat energy consumed in the fixing process of toner image. In order to reduce the heat demand in the fixing process of toner image, there has been a need for improving low-temperature fixing property of an electrostatic image developing toner (also simply referred to as "toner", hereinafter). One known method of achieving the purpose is to use, as a binder resin, a crystalline resin such as crystalline polyester characterized by its sharp melting performance.

For example, JP-A-2006-251564 proposes an electrostatic image developing toner which contains a binder resin in which a crystalline polyester resin and an amorphous resin are mixed. By using the crystalline polyester resin and the amorphous resin in a mixed manner, the fixing temperature may be lowered, since the crystalline moiety melts when the toner is heated during fixing above the melting point of the crystalline polyester resin, and thereby the crystalline polyester resin and the amorphous resin become dissolved to each other. This sort of toner has, however, been suffering from an excessive glossiness of image and glare, since the crystalline polyester resin and the amorphous resin fuse with each other during fixation under heating to cause a sharp fall in melt viscosity of the resin as a whole.

A possible method of suppressing such excessive increase in the glossiness is to allow the crystalline polyester and a high-softening-point vinyl resin to form a domain phase in an amorphous resin used as a matrix. According to the description, the high-softening point vinyl resin starts to melt into the matrix when kept at high temperatures during fixation under heating, so that the matrix reduces the viscosity only slowly, the glossiness may therefore be suppressed from excessive increase, and thereby the glossiness may be stabilized on a variety of paper types.

Even such toner has, however, not been still enough to suppress the excessive increase in glossiness, making the resultant image highly glossy, and making a character image less readable due to glare. The toner is still insufficient regarding recent requirements for lower fixing temperature for coping with higher printing speed, and a wider variety of paper types (including printing on coated paper).

In short, it has been difficult to properly balance the low-temperature fixing property with the property allowing formation of low-gloss image (low glossiness), leaving the toner still on the way to acquire a sufficiently low glossiness.

SUMMARY OF THE INVENTION

The present invention, in consideration of the above-described problems and circumstances, is to provide an electrostatic image developing toner which is excellent in low-temperature fixing property and low glossiness.

The present invention is to further provide an electrostatic image developing toner which is excellent in storage performance under heating, and capable of forming a high quality image over a long term.

In the process of studies aimed at solving the problems above, the present inventors found that an electrostatic image developing toner excellent in the low-temperature fixing property and low glossiness may be provided, by using a binder resin which contains at least an amorphous vinyl resin and a crystalline polyester resin, and by respectively specifying ranges of the weight-average molecular weight of the electrostatic image developing toner, ratio of a resin component having a molecular weight of 100000 or more, melting point of the crystalline polyester resin, and content of the crystalline polyester resin.

The above-described object of the present invention can be solved by the following embodiments.

1. An electrostatic image developing toner including a toner base particle containing a binder resin and a releasing agent, wherein the binder resin includes an amorphous vinyl resin and a crystalline polyester resin;

a weight-average molecular weight of the electrostatic image developing toner is in the range of 50000 to 90000, when calculated from a chromatogram which represents a molecular weight distribution and is measured by gel permeation chromatography;

a ratio of content of a resin component having a molecular weight of 100000 or more is in the range of 10 to 20% by area, in the chromatogram which represents the molecular weight distribution;

the crystalline polyester resin has a melting point in the range of 65 to 85° C.; and, a ratio of content of the crystalline polyester resin in the binder resin is in the range of 5 to 20% by mass.

2. The electrostatic image developing toner of item 1, wherein a ratio of content of the amorphous vinyl resin in the binder is 50% by mass or more.
3. The electrostatic image developing toner of item 1, wherein the crystalline polyester resin is a single polymer synthesized by a polycondensation reaction between a polyhydric alcohol component and a polycarboxylic acid component.
4. The electrostatic image developing toner of item 1, wherein the crystalline polyester resin is a hybrid crystalline polyester resin having copolymerized therein a crystalline polyester resin unit synthesized by a polycondensation reaction between a polyhydric alcohol component and a polycarboxylic acid component, and an amorphous resin unit other than polyester resin.
5. The electrostatic image developing toner of item 4, wherein the amorphous resin unit is a vinyl resin unit.
6. The electrostatic image developing toner of item 4, wherein the ratio of content of the amorphous resin unit in the hybrid crystalline polyester resin is in the range of 5 to 20% by mass.
7. The electrostatic image developing toner of item 3, wherein the number of carbon atoms of the polyhydric alcohol component (C(alcohol)) and the number of carbon atoms of the polycarboxylic acid component C(acid)) satisfy the relations represented by Expressions (1) to (3) below:

$$C(acid)-C(alcohol)\geq 4 \quad \text{Expression (1)}$$

$$C(acid)\geq 10 \quad \text{Expression (2)}$$

$$C(alcohol)\leq 6 \quad \text{Expression (3)}$$

8. The electrostatic image developing toner of item 1, wherein a weight-average molecular weight of the crystalline polyester resin is in the range of 15000 to 40000, when calculated from a chromatogram which represents a molecular weight distribution and is measured by gel permeation chromatography.

Although manifestation mechanism and operation mechanism of the effects of the present invention remain unclear, they are presumed as follows.

The crystalline polyester resin is effective to improve the low-temperature fixing property of the toner. More specifically, by using the crystalline polyester resin and the amorphous resin in a mixed manner, the crystal moiety may melt when heated above the melting point of the crystalline polyester resin, and may be dissolved into the amorphous resin, thereby providing low-temperature fixing property.

In the present invention, since the crystalline polyester resin having a melting point of 65 to 85° C. is used, so that the crystalline polyester resin is considered to melt under heating for fixing and to become dissolved into the amorphous resin, and so that the resin is considered to be fully softened, enough to obtain the low-temperature fixing property.

Since the high molecular weight component such as having a molecular weight of 100000 or more fuses with the crystalline polyester resin not so easily, so that the toner as a whole can keep a certain level of elasticity. Accordingly, the image will have a surface roughness during fixation under heating, to produce a low-gloss image. More specifically, in the process of fixation under heating, the crystalline polyester resin fuses with the low molecular weight component of the amorphous resin to reduce the viscosity, meanwhile it does not so easily fuse with the high molecular weight component of the amorphous resin, so that the toner as a whole can keep a certain level of elasticity. As a consequence, a low gloss image can be formed, while satisfying the low-temperature fixing property.

The present inventors presume that, in the binder containing the high molecular weight component, the crystalline polyester resin will be blocked from causing thermal motion by the high molecular weight resin, and thereby suppressed from dropping from the toner, so that the toner will be capable of producing high quality images in a stable manner over a long term, without causing image defect such as white streak.

DETAILED DESCRIPTION OF THE PREFERRED EMBODIMENTS

The electrostatic image developing toner of the present invention is featured in that the binder resin contains at least an amorphous vinyl resin and a crystalline polyester resin; the electrostatic image developing toner has a weight-average molecular weight in the range of 50000 to 90000, when calculated from a chromatogram which represents the molecular weight distribution and is measured by gel permeation chromatography; that the ratio of content of a resin component having a molecular weight of 100000 or more is in the range of 10 to 20% by area in the chromatogram which represents the molecular weight distribution; that the crystalline polyester resin has a melting point in the range of 65 to 85° C.; and that the ratio of content of the crystalline polyester resin, in the binder resin, is in the range of 5 to 20% by mass. These features are technical features common to all inventions according to the individual items.

In embodiments of the present invention, the ratio of content of the amorphous vinyl resin is preferably 50% by mass or more.

The amorphous vinyl resin is easily controllable in terms of molecular weight, and is suitable for obtaining a high molecular weight component having a molecular weight of 100000 or more. The amorphous vinyl resin is also suitable for properly balancing low-temperature fixing property and low glossiness, since it moderately dissolves with the crystalline polyester resin.

Although the crystalline polyester resin may be a single polymer synthesized by a polycondensation reaction between the polyhydric alcohol component and a polycarboxylic acid component, particularly preferable is a hybrid crystalline polyester resin obtained by copolymerization of a crystalline polyester resin unit synthesized by a polycondensation reaction between a polyhydric alcohol component and a polycarboxylic acid component, with an amorphous resin unit other than polyester resin.

By using the hybrid crystalline polyester resin, the crystalline polyester resin will have a moderately improved affinity to the main binder, and will more thoroughly be dispersed into the toner base particle. This will largely contribute to lower the fixation temperature and to stabilize image quality.

The amorphous resin unit is preferably a vinyl resin unit. As a result of inclusion, in the crystalline polyester resin, of a resin component analogous to the amorphous vinyl resin, the crystalline polyester resin rapidly dissolves into the amorphous vinyl resin in the process of fixation under heating, proving a good low-temperature fixing property. The crystalline polyester resin becomes introduced more easily into the binder resin, and will be less likely to expose to the surface, so that the storage performance under heating, and uniformity of electrification are improved.

The ratio of content of the amorphous resin unit in the hybrid crystalline polyester resin preferably is in the range of 5 to 20% by mass. With the ratio of content of the amorphous resin unit falling within such range, affinity between the main binder and the crystalline polyester resin improves properly, and dispersion property of the crystalline polyester resin is increased in the toner base particle. This will largely contribute to lower the fixation temperature and to stabilize image quality.

In the present invention, the ratio of content of the amorphous resin unit is defined by the ratio of content (% by mass) of a source monomer of the amorphous resin unit, relative to the total content (100% by mass) of the source monomer of the crystalline polyester resin unit and the source monomer of the amorphous resin unit, in the process of synthesis of the hybrid crystalline polyester resin.

The number of carbon atoms of the polyhydric alcohol component (C(alcohol)), and the number of carbon atoms of the polycarboxylic acid component (C(acid)) preferably satisfy the relations represented by Formulae (1) to (3).

Since the crystalline polyester resin, whose source materials have specified numbers of carbon atoms, is formed using the polyhydric alcohol component and the polycarboxylic acid having different lengths of the principal chains, so that the polyester chain will have, alternately bound thereto, branch chains having a small number of carbon atoms and branch chains having a large number of carbon atoms. Accordingly, the crystalline polyester resin is considered to have an irregular moiety during crystallization. As a consequence, by using the crystalline polyester resin whose source materials have specified numbers of carbon atoms, as the crystalline polyester resin composing the binder resin, the crystalline polyester resin, when given a heat energy above the melting point thereof during fixation under heating, will melt in such a way that the moiety having an irregularity melts earlier. A good low-temperature fixing property will thus be obtained.

The weight-average molecular weight (Mw) of the crystalline polyester resin, when calculated from a chromatogram which represents the molecular weight distribution and is measured by gel permeation chromatography, preferably falls in the range of 15000 to 40000. Within this range, the crystalline polyester resin can uniformly disperse in the main binder which contains a high molecular weight component having a molecular weight of 100000 or more, and becomes less likely to drop from the toner due to thermal motion, so that image defect is avoidable.

The present invention, the constituents thereof, and modes and embodiments for carrying out the present invention will be detailed below. Note, in this application, all numerical ranges given in the form with "to", preceded and succeeded by numerals, shall be defined to contain these numerals as the lower and upper limit values.

«Electrostatic Image Developing Toner»

The electrostatic image developing toner of the present invention contains the toner base particle which contains at least the binder resin and the releasing agent.

The weight-average molecular weight (Mw) of the electrostatic image developing toner is in the range of 50000 to 90000, and preferably in the range of 55000 to 85000, when calculated from a chromatogram which represents the molecular weight distribution and is measured by gel permeation chromatography.

If the weight-average molecular weight (Mw) is smaller than 50000, the obtained image will become highly glossy and less stable when stored over a long term, meanwhile if larger than 90000, the low-temperature fixing property will degrade.

In the chromatogram which represents the molecular weight distribution, the ratio of content of the resin component having a molecular weight of 100000 or more is in the range of 10 to 20% by area, and more preferably in the range of 12 to 18% by area.

If the ratio of content of the resin component having a molecular weight of 100000 or more is smaller than 10% by area, the obtained image will become highly glossy and less stable when stored over a long term. If the ratio is larger than 20% by area, the low-temperature fixing property will degrade.

The ratio of content of the resin component of the toner, having a molecular weight of 300000 or more, is preferably in the range of 2 to 9% by area.

In the present invention, the molecular weight distribution is measured by gel permeation chromatography (GPC), as described below.

Using an apparatus "HLC-8220" (from Tosoh Corporation) and columns "TSK guard column+TSKgel Super HZM-M, triple configuration" (from Tosoh Corporation), tetrahydrofuran (THF) is allowed to flow therethrough as a carrier solvent at a flow rate of 0.2 mL/min, while keeping the column temperature at 40° C. A sample to be measured is dissolved into tetrahydrofuran at room temperature (25° C.) using a ultrasonic disperser for 5 minutes, so as to adjust the concentration to 1 mg/mL, the solution was filtered through a membrane filter having a pore size of 0.2 μm, 10 μL of the thus obtained sample solution is injected into the apparatus together with the carrier solvent described above. The sample is detected using a refractive index (RI) detector, and the molecular weight distribution of the sample to be measured is determined based on a standard curve obtained by using a monodisperse standard polystyrene particle. The standard polystyrene samples used for obtaining the standard curve are those having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, all from Pressure Chemical Company. The standard curve is prepared by using at least such 10 species of standard polystyrene sample. An RI detector is used as the detector.

The ratio of content of the high molecular weight component (for example, having a molecular weight of 100000 or more) was calculated as the ratio by area of the resin component having a molecular weight of 100000 or more, assuming the total area of peaks assignable to THF soluble moiety of the toner, in the gel permeation chromatogram which represents the molecular weight distribution obtained as described above as 100% by area.

The individual materials composing the electrostatic image developing toner will be explained below.

<Toner Base Particle>

According to the present invention, the toner base particle is configured to contain at least a binder resin and a releasing agent.

In the present invention, toner base particle added with external additive will be referred to as "toner particle", meanwhile an assemblage of the toner base particle or the toner particle will be referred to as "toner". Although the toner base particle may be used typically without modification, in the present invention, the toner base particle added with the external additive is used as the toner particle.

<Binder Resin>

The binder resin in the present invention contains at least the amorphous vinyl resin and the crystalline polyester resin.

(Amorphous Vinyl Resin)

The amorphous vinyl resin in the present invention is formed by using a monomer having a vinyl group (referred to as "vinyl monomer", hereinafter). The amorphous vinyl resin is exemplified by styrene-acrylic resin, styrene resin, and acrylic resin, wherein styrene-acrylic resin is preferable.

The amorphous resin in the present invention is defined as a resin which shows no distinct endothermic peak in an endothermic curve in the process of heating, when measured by differential scanning calorimetry (DSC). The "distinct endothermic peak" herein means an endothermic peak having a half value width of 15° C. or less, when measured by DSC at a heating rate of 10° C./min. The endothermic curve may be obtained typically by using a differential scanning calorimeter "Diamond DSC" (from PerkinElmer Inc.).

The vinyl monomer is exemplified as below.

(1) Styrene-Based Monomer

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and derivatives of these compounds.

(2) (Meth)Acrylic Ester-Based Monomer

Methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth)acrylate, dimethylaminoethyl (meth)acrylate, and derivatives of these compounds.

(3) Vinyl Esters

Vinyl propionate, vinyl acetate, vinyl benzoate, etc.

(4) Vinyl Ethers

Vinyl methyl ether, vinyl ethyl ether, etc.

(5) Vinyl Ketones

Vinyl methyl ketone, vinyl ethyl ketone, vinyl hexyl ketone, etc.

(6)N-Vinyl Compounds

N-Vinylcarbazole, N-vinylindole, N-vinylpyrrolidone, etc.

(7) Others

Vinyl compounds such as vinylnaphthalene and vinylpyridine; acrylic or methacrylic acid derivatives such as acrylonitrile, methacrylonitrile, and acrylamide.

The vinyl monomer may be used alone or may be used in combination of two or more kinds.

Preferably used vinyl monomer are monomers having any of ionic dissociation groups such as carboxy group, sulfonic acid group, and phosphoric acid group. Specific examples are as below.

The monomers having carboxy group(s) are exemplified by acrylic acid, methacrylic acid, maleic acid, itaconic acid, cinnamic acid, fumaric acid, monoalkyl maleate, and monoalkyl itaconate.

The monomers having sulfonic acid group are exemplified by styrenesulfonic acid, allylsulfosuccinic acid, and 2-acrylamido-2-methylpropanesulfonic acid.

The monomers having phosphoric acid group are exemplified by acid phosphoxyethyl methacrylate.

Also multi-functional vinyl compounds may be used as the vinyl monomer, so as to make the vinyl polymer have a crosslinked structure.

The multi-functional vinyl compounds are exemplified by divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

The ratio of content of the amorphous vinyl resin in the binder resin is preferably 50% by mass or more, and more preferably 70% by mass or more.

(Crystalline Polyester Resin)

The crystalline polyester resin in the present invention is featured in that the ratio of content thereof in the binder resin is in the range of 5 to 20% by mass, and, the melting point ($T_{mc}$) thereof is in the range of 65 to 85° C.

If the ratio of content of the crystalline polyester resin is smaller than 5% by mass, the low-temperature fixing property may degrade, meanwhile if 20% by mass or more, the storage performance under heating and long-term image stability may degrade. The ratio of content of the crystalline polyester resin is preferably in the range of 7 to 15% by mass.

If the melting point of the crystalline polyester resin is lower than 65° C., the storage performance under heating may degrade, meanwhile if higher than 85° C., the low-temperature fixing property may degrade. The melting point of the crystalline polyester resin is preferably in the range of 70 to 80° C.

In the present invention, the melting point of the crystalline polyester resin may be measured by differential scanning calorimetry (DSC) of the toner.

The melting point may be measured typically by using a differential scanning calorimeter "Diamond DSC" (from PerkinElmer Inc.). The measurement is conducted according to measurement conditions (heating/cooling conditions) including, in the following order, a first heating process involving heating at a heating rate of 10° C./min from room temperature (25° C.) up to 150° C., followed by isothermal holding at 150° C. for 5 minutes; a cooling process involving cooling at a cooling rate of 10° C./min from 150° C. down to 0° C., followed by isothermal holding at 0° C. for 5 minutes; and a second heating process involving heating at a heating rate of 10° C./min from 0° C. up to 150° C. In the measurement, 3.0 mg of the toner is placed in an aluminum pan, and the pan is set on a sample holder of differential scanning calorimeter "Diamond DSC". A vacant aluminum pan is used as the reference.

In the measurement, an endothermic curve obtained in the first heating process is analyzed to determine the melting point ($T_{mc}$) (° C.) of the crystalline polyester resin, based on the temperature at which the endothermic peak assignable to the crystalline polyester resin becomes deepest.

The crystalline polyester resin according to the present invention may be obtained by a polycondensation reaction between a di- or higher hydric alcohol (polyhydric alcohol component) and a di- or higher carboxylic acid (polycarboxylic acid component).

In the present invention, "crystalline" resin is defined as a resin which shows a distinct endothermic peak in an endothermic curve in the process of heating, when measured by differential scanning calorimetry (DSC). The "distinct endothermic peak" herein means an endothermic peak having a half value width of 15° C. or less, when measured by DSC at a heating rate of 10° C./min.

The crystalline polyester resin is not specifically limited so far as described above. For example, the crystalline polyester resin may be a single polymer synthesized by a polycondensation reaction between a polyhydric alcohol component and a polycarboxylic acid component; or may be a hybrid crystalline polyester resin having copolymerized therein a crystalline polyester resin unit synthesized by a polycondensation reaction between a polyhydric alcohol component and a polycarboxylic acid component, and an amorphous resin unit other than polyester resin, wherein the hybrid crystalline polyester resin is preferable.

The hybrid crystalline polyester resin is exemplified by a resin in which the principal chain composed of the crystalline polyester resin unit is copolymerized with other component; and a resin in which the crystalline polyester resin unit is copolymerized to the principal chain composed of other component.

The polyhydric alcohol component is exemplified by dihydric alcohols such as ethylene glycol, propylene glycol, butanediol, diethylene glycol, hexanediol, cyclohexanediol, octanediol, decanediol, dodecanediol, ethylene oxide adduct of bisphenol A, and propylene oxide adduct of bisphenol A; tri- or higher-hydric polyols such as glycerin, pentaerythritol, hexamethylol melamine, hexaethylol melamine, tetramethylol benzoguanamine, and tetraethylol benzoguanamine; esterified product of these compounds; and hydroxycarboxylic acid derivatives.

The polycarboxylic acid component is exemplified by dicarboxylic acids such as oxalic acid, succinic acid, maleic acid, mesaconic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, and dodecenylsuccinic acid; tri- and higher-carboxylic acids such as trimellitic acid, pyromellitic acid, naphthalene tricarboxylic acid, naphthalene tetracarboxylic acid, pyrene tricarboxylic acid, and pyrene tetracarboxylic acid; and alkyl esters, acid anhydrides and acid chlorides of these compounds.

The number of carbon atoms (C(alcohol)) of the polyhydric alcohol component, and the number of carbon atoms (C(acid)) of the polycarboxylic acid component preferably satisfy the relations represented by Expressions (1) to (3) below:

$$C(acid)-C(alcohol)\geq 4 \quad \text{Expression (1)}$$

$$C(acid)\geq 10 \quad \text{Expression (2)}$$

$$C(alcohol)\leq 6 \quad \text{Expression (3)}$$

Further to satisfying the Expression (1) (C(acid)−C(alcohol)≥4), it is more preferable to satisfy C(acid)−C(alcohol) ≥6.

When two or more species of the polycarboxylic acid component are used, C(acid) is defined as the number of carbon atoms of the polycarboxylic acid component whose ratio of content (molar equivalent) is largest of all. If there are polycarboxylic acid components having the same ratio of content, C(acid) is defined as the number of carbon atoms of the polycarboxylic acid component whose number of carbon atoms is largest of all.

Similarly, when two or more species of the polyhydric alcohol component are used, C(alcohol) is defined as the number of carbon atoms of the polyhydric alcohol component whose ratio of content (molar equivalent) is largest of all. If there are polyhydric alcohol components having the same ratio of content, C(alcohol) is defined as the number of carbon atoms of the polyhydric alcohol component whose number of carbon atoms is largest of all.

The weight-average molecular weight (Mw) of the crystalline polyester resin, when calculated from a chromatogram which represents the molecular weight distribution and is measured by gel permeation chromatography, is preferably in the range of 15000 to 40000.

The molecular weight distribution of the crystalline polyester resin may be measured by gel permeation chromatography, in the same way as the measurement of the molecular weight distribution of the toner described above.

The crystalline polyester resin may be formed by any method not specially limited, typically by polycondensing (esterifying) the polyhydric alcohol component and the polycarboxylic acid component, using a known esterification catalyst.

The ratio of the polyhydric alcohol component and the polycarboxylic acid component being used is preferably in the range of 1.5/1 to 1/1.5, and more preferably in the range of 1.2/1 to 1/1.2, in terms of equivalence ratio of the hydroxy group of the polyhydric alcohol component to the carboxy group of the polycarboxylic acid component.

The catalyst usable for manufacturing the crystalline polyester resin is exemplified by alkali metal compounds containing sodium, lithium and so forth; alkali earth metal compounds containing magnesium, calcium and so forth; metal compounds containing aluminum, zinc, manganese, antimony, titanium, tin, zirconium, germanium and so forth; phosphorous acid compounds; phosphoric acid compounds; and amine compounds.

Specific examples of the tin compound include dibutyl tin oxide, tin octylate, tin dioctylate, and salts of these compounds.

Examples of the titanium compound include titanium alkoxides such as tetra n-butyl titanate, tetraisopropyl titanate, tetramethyl titanate, tetrastearyl titante; titanium acylates such as polyhydroxytitanium stearate; and titanium cheletes such as titanium tetraacetylacetonate, titanium lactate, and titanium triethanolaminate.

Examples of the germanium compound include germanium dioxide.

Examples of the aluminum compound include hydroxides such as polyhydroxy aluminum; aluminum alkoxides; and tributyl aluminate.

These compounds may be used alone or may be used in combination of two or more kinds.

The polymerization temperature and polymerization time are not specifically limited. The reaction system during polymerization may optionally be decompressed.

When the crystalline polyester resin is the hybrid crystalline polyester resin having the crystalline polyester resin unit and the amorphous resin unit copolymerized therein, the ratio of content of the crystalline polyester resin unit, relative to the total content of the hybrid crystalline polyester resin, is preferably 50% by mass or more and less than 98% by mass. Within this range, the hybrid crystalline polyester resin will be given a sufficient level of crystallinity. The constitutive units and the ratio of contents thereof in the hybrid crystalline polyester resin may be identified typically by NMR, or P-GC/MS during methylation.

The hybrid crystalline polyester resin may be any of block copolymer, graft copolymer and so forth, so long as it contains the crystalline polyester resin unit and the amorphous resin unit, wherein it may preferably be a graft copolymer. Given the form of graft copolymer, the crystalline polyester resin unit will be aligned more easily, and thereby the hybrid crystalline polyester resin will be given a sufficient level of crystallinity.

The crystalline polyester resin unit is preferably grafted to the principal chain composed of the amorphous resin unit other than the crystalline polyester resin. In other words, the hybrid crystalline polyester resin is preferably a graft copolymer in which the principal chain thereof contains the amorphous resin unit other than polyester resin, and the side chain thereof contains the crystalline polyester resin unit.

With such configuration, the crystalline polyester resin unit may be aligned more strongly, and thereby the hybrid crystalline polyester resin may be improved in crystallinity.

The hybrid crystalline polyester resin may have introduced therein an additional substituent such as sulfonic acid group, carboxy group, or urethane group. These substituents may be introduced into the crystalline polyester resin unit, or into the amorphous resin unit other than polyester resin detailed below.

(Amorphous Resin Unit Other than Polyester Resin)

The amorphous resin unit other than polyester resin is a moiety derived from amorphous resin other than the crystalline polyester resin.

The amorphous resin unit is a resin unit showing no melting point but a relatively high glass transition temperature (Tg), when measured by differential scanning calorimetry (DSC) using a resin having a chemical structure and molecular weight same as those of such unit.

The amorphous resin unit is not specifically limited so far as described above. For example, if there is a resin having a structure in which the other component is copolymerized to the principal chain composed of the amorphous resin unit, or if there is a resin having a structure in which the amorphous resin unit is copolymerized to the principal chain composed of the other component, and if the toner containing such resin has the above-described amorphous resin unit, the resin then falls under the hybrid crystalline polyester resin having the amorphous resin unit, in the context of the present invention.

The amorphous resin unit is preferably a vinyl resin unit which is the same resin as the amorphous vinyl resin contained in the binder resin. With such configuration, the hybrid crystalline polyester resin will have an enhanced affinity to the amorphous vinyl resin, and will be introduced into the amorphous vinyl resin more easily, to further improve the uniformity of electrification.

The "same resin" herein means that a characteristic chemical bond is contained commonly in the repeating units. The "characteristic chemical bond" herein follows the "polymer classification" described in National Institute for Materials Science (NIMS) Materials Database (http://polymer.nims.go.jp/PoLyInfo/guide/jp/term_polymer.html). In more detail, the "characteristic chemical bonds" are chemical bonds composing any of 22 classes of polymers, including polyacrylic resin, polyamide, polyacid anhydride, polycarbonate, polydiene, polyester, polyhaloolefin, polyimide, polyimine, polyketone, polyolefin, polyether, polyphenylene, polyphosphazene, polysiloxane, polystyrene, polysulfide, polysulfone, polyurethane, polyurea, polyvinyl resin and other polymers.

If the resin is a copolymer and a plurality of monomer species composing the copolymer are those having any of the characteristic chemical bonds listed above, any resins commonly having the characteristic chemical bonds are regarded as the "same resin". In this context, any resins commonly having the characteristic chemical bonds are regarded as the same resin, even if characteristics intrinsic to the individual resins are different, or even if the molar composition ratios of the monomer species composing the copolymers are different.

For example, a resin (or resin unit) composed of styrene, butyl acrylate and acrylic acid, and a resin (or resin unit) composed of styrene, butyl acrylate and methacrylic acid are regarded as the same resin, since both of them commonly have at least a chemical bond for composing polyacrylic resin. In another example, a resin (or resin unit) composed of styrene, butyl acrylate and acrylic acid, and a resin (or resin unit) composed of styrene, butyl acrylate, acrylic acid, terephthalic acid and fumaric acid are again regarded as the same resin, since both of them have at least a chemical bond for composing polyacrylic resin.

The resin component for composing the amorphous resin unit is exemplified by, but not limited to, vinyl resin unit, urethane resin unit, and urea resin unit. Among them, vinyl resin unit is preferable since the thermoplasticity may be controlled easily.

The vinyl resin unit is not specifically limited, so long as it is a polymerization product of the vinyl monomer, and is exemplified by acrylic ester resin unit, styrene-acrylic ester resin unit, and ethylene-vinyl acetate resin unit. They may be used alone or may be used in combination of two or more kinds.

Method of forming the styrene-acrylic resin unit is not specifically limited, and is exemplified by a method of polymerizing monomers using a known oil-soluble or water-soluble polymerization initiator. Specific examples of the oil-soluble polymerization initiator include azo-based or diazo-based polymerization initiator, and peroxide-based polymerization initiator.

The azo-based or diazo-based polymerization initiator is exemplified by 2,2'-azobis(2,4-dimethylvaleronitrile), 2,2'-azobis(isobutyronitrile), 1,1'-azobis(cyclohexane-1-carbonitrile), 2,2'-azobis(4-methoxy-2,4-dimethylvaleronitrile), and azobis(isobutyronitrile).

The peroxide-based polymerization initiator is exemplified by benzoyl peroxide, methyl ethyl ketone peroxide, diisopropyl peroxycarbonate, cumen hydroperoxide, t-butyl hydroperoxide, di-t-butyl peroxide, dicumyl peroxide, 2,4-dichlorobenzoyl peroxide, lauroyl peroxide, 2,2-bis(4,4-t-butylperoxycyclohexyl)propane, and tris(t-butylperoxy)triazine.

When the resin particle is formed by emulsion polymerization, a water-soluble radical polymerization initiator may be used. The water-soluble polymerization initiator is exemplified by persulfate salts such as potassium persulfate and ammonium per sulfate; azobis(amidinopropane) acetate, azobis(cyanovaleric acid) and salt thereof, and hydrogen peroxide.

The ratio of content of the amorphous resin unit is preferably in the range of 5 to 20% by mass, relative to the total content of the hybrid crystalline polyester resin.

(Method of Manufacturing Hybrid Crystalline Polyester Resin)

Method of manufacturing the hybrid crystalline polyester resin contained in the binder resin in the present invention is not specifically limited, so long as it can form a copolymer having a molecular structure obtained by binding the crystalline polyester resin unit with the amorphous resin unit. Specific examples of the method of manufacturing the hybrid crystalline polyester resin include the followings.

(1) Method of Manufacturing the Hybrid Crystalline Polyester Resin, by Preliminarily Polymerizing the Amorphous Resin Unit, and then Allowing a Polymerization Reaction for Forming the Crystalline Polyester Resin Unit to Proceed, Under the Presence of the Amorphous Resin Unit.

According to this method, first, monomers for composing the amorphous resin unit (preferably, a styrene monomer and a vinyl monomer such as (meth)acrylic ester monomer) are subjected to addition polymerization, to form the amorphous resin unit.

Next, under the presence of the amorphous resin unit, the polyhydric alcohol component and the polycarboxylic acid component are subjected to a polycondensation reaction, to form the crystalline polyester resin unit. In this process, the polyhydric alcohol component is polycondensed with the polycarboxylic acid component, and concurrently the polyhydric alcohol component or the polycarboxylic acid is added to the amorphous resin unit. The hybrid crystalline polyester resin is thus formed.

In this method, the crystalline polyester resin unit or the amorphous resin unit preferably has, preliminarily introduced therein, a reaction site at which these units can react with each other. More specifically, in the process of forming the amorphous resin unit, besides the monomer for composing the amorphous resin unit, also used is a compound having a site capable of reacting with a carboxy group or hydroxy group remained in the crystalline polyester resin unit, and a site capable of reacting with the amorphous resin unit. In other words, as a result of reaction of this compound with the carboxy group or hydroxy group in the crystalline polyester resin unit, the crystalline polyester resin unit can chemically combine with the amorphous resin unit.

Alternatively, in the process of forming the crystalline polyester resin unit, usable is a compound having a site capable of reacting with the polyhydric alcohol component or the polycarboxylic acid component, and capable of reacting with the amorphous resin unit.

By using such method, the hybrid crystalline polyester resin, having a molecular structure (graft structure) in which the crystalline polyester resin unit is bound to the amorphous resin unit, may be formed.

(2) Method of Manufacturing the Hybrid Crystalline Polyester Resin, by Preliminarily Forming the Crystalline Polyester Resin Unit and the Amorphous Resin Unit in an Independent Manner, and then by Combining them.

According to this method, first, the polyhydric alcohol component and the polycarboxylic acid component are subjected to a polycondensation reaction to form the crystalline polyester resin unit. Independently from the reaction system for forming the crystalline polyester resin unit, the monomers for composing the amorphous resin unit are subjected to addition polymerization to form the amorphous resin unit. In this process, the crystalline polyester resin unit and the amorphous resin unit preferably has, preliminarily introduced therein, a reaction site at which these units can react with each other. Methods of introducing such reaction site are as described above, and will not be detailed again.

Next, the thus-formed crystalline polyester unit and the amorphous resin unit are allowed to react, to thereby successfully form the hybrid crystalline polyester resin having a molecular structure in which the crystalline polyester resin unit and the amorphous resin unit are combined.

When the crystalline polyester resin unit and the amorphous resin unit have no reaction site preliminarily introduced therein, another possible method is to preliminarily form a system in which the crystalline polyester resin unit and the amorphous resin unit coexist, and to add a compound capable of binding with the crystalline polyester resin unit and the amorphous resin unit. This successfully forms the hybrid crystalline polyester resin having a molecular structure in which the crystalline polyester resin unit and the amorphous resin unit are combined through such compound.

(3) A Method of Manufacturing the Hybrid Crystalline Polyester Resin, by Preliminarily Forming the Crystalline Polyester Resin Unit, and then Allowing a Polymerization Reaction for Forming the Amorphous Resin Unit to Proceed, Under the Presence of the Crystalline Polyester Resin Unit.

According to this method, first, the polyhydric alcohol component and the polycarboxylic acid are subjected to a polycondensation reaction to form the crystalline polyester resin unit.

Next, under the presence of the crystalline polyester resin unit, the monomers for composing the amorphous resin unit are subjected to a polymerization reaction to form the amorphous resin unit. In this process, similarly to (1) described above, the crystalline polyester resin unit or the amorphous resin unit preferably has, preliminarily introduced therein, a reaction site at which these units can react with each other. Methods of introducing such reaction site are as described above, and will not be detailed again.

By using such method, the hybrid crystalline polyester resin, having a molecular structure (graft structure) in which the amorphous resin unit is bound to the crystalline polyester resin unit, may be formed.

Among the methods described in (1) to (3) above, the method of (1) is preferable, since it can easily produce the hybrid crystalline polyester resin having a structure in which the crystalline polyester resin unit chain is grafted to the amorphous resin unit chain, and since the production process may be simplified.

Since, in the method described in (1), the amorphous resin unit is preliminarily formed, and the crystalline polyester resin unit is then combined thereto, so that the crystalline polyester resin unit becomes more likely to align uniformly. The method is therefore preferable, in view of reliably forming the hybrid crystalline polyester resin which is suitable for the toner specified in the present invention.

<Releasing Agent>

The releasing agent is not specifically limited, and known various types of waxes may be used as the releasing agent. Examples of the waxes include polyolefin waxes such as polyethylene wax and polypropylene wax; branched hydrocarbon waxes such as micro-crystalline wax; long-chain hydrocarbon waxes such as paraffin wax and sasol wax; dialkyl ketone-based waxes such as distearyl ketone; ester-based waxes such as carnauva wax, montan wax, behenyl behenate, trimethylolpropane tribehenate, pentaerythritol tetrabehenate, pentaerythritol diacetate dibehenate, glycerin tribehenate, 1,18-octadecanediol distearate, tristearyl trimellitate, and distearyl maleate; and amide-based waxes such as ethylenediamine behenylamide, and trimellitic acid tristearylamide.

The content of the releasing agent is typically in the range of 1 to 30 parts by mass, and more preferably in the range of 5 to 20 parts by mass, relative to 100 parts by mass of the binder resin. With the content of the releasing agent controlled in these ranges, a sufficient level of releasability after fixation may be obtained.

The content of the releasing agent in the toner base particle is preferably in the range of 3 to 15% by mass.

<Colorant>

Any of publicly known dyes and pigments may be used as the colorant.

The colorant for obtaining black toner is freely selectable from known various species including carbon blacks such as furnace black and channel black; magnetic materials such as magnetite and ferrite; dye; and inorganic pigments including non-magnetic iron oxide.

The colorant for obtaining color toner is freely selectable from known dyes and organic pigments. Examples of the organic pigment include C.I. Pigment Red 5, ditto 48:1, ditto 53:1, ditto 57:1, ditto 81:4, ditto 122, ditto 139, ditto 144, ditto 149, ditto 166, ditto 177, ditto 178, ditto 222, ditto 238, ditto 269, C.I. Pigment Yellow 14, ditto 17, ditto 74, ditto 93, ditto 94, ditto 138, ditto 155, ditto 180, ditto 185, C.I. Pigment Orange 31, ditto 43, C.I. Pigment Blue 15:3, ditto 60, and ditto 76; and examples of the dye include C.I. Solvent Red 1, ditto 49, ditto 52, ditto 58, ditto 68, ditto 11, ditto 122, C.I. Solvent Yellow 19, ditto 44, ditto 77, ditto 79, ditto 81, ditto 82, ditto 93, ditto 98, ditto 103, ditto 104, ditto 112, ditto 162, C.I. Solvent Blue 25, ditto 36, ditto 69, ditto 70, ditto 93 and ditto 95.

For each color, the colorant for obtaining the toner of each color may be used alone or may be used in combination of two or more kinds.

The content of colorant, per 100 parts by mass of the binder resin, is preferably in the range of 1 to 10 parts by mass, and more preferably in the range of 2 to 8 parts by mass.

<Charge Controlling Agent>

Known various species of compounds may be used as a charge controlling agent.

The content of charge controlling agent is typically in the range of 0.1 to 5.0 parts by mass, per 100 parts by mass of binder resin.

<External Additive>

Although the toner base particle in the present invention may be used without modification to configure the electrostatic image developing toner of the present invention, the toner base particle may be added with an external additive such as fluidizing agent or cleaning aid, known as a so-called post treatment agent, for the purpose of improving fluidity, chargeability and efficiency of cleaning.

The post-treatment agent is exemplified by inorganic oxide fine particles such as silica fine particle, alumina fine particle and titanium oxide fine particle; inorganic stearate compound fine particles such as aluminum stearate fine particle and zinc stearate fine particle; and inorganic titanate compound fine particles such as strontium titanate and zinc titanate. Only a single species of these compounds may be used, or two or more species may be used in combination.

These inorganic fine particles are preferably glossified using a silane coupling agent, titanium coupling agent, higher fatty acid, silicone oil or the like, in order to improve the storage performance under heating and environmental stability.

The total amount of addition of these various external additives is preferably in the range of 0.05 to 5 parts by mass, and more preferably in the range of 0.1 to 3 parts by mass, per 100 parts by mass of the toner.

<Particle Size of Toner Particle>

The average particle size of toner particle is preferably in the range of 3 to 10 μm, and more preferably in the range of 5 to 8 μm, in terms of volume-based median diameter ($d_{50}$).

The average particle size of the toner particle may be controlled by the concentration of a coagulant used in the process of manufacturing, the amount of addition of the organic solvent, fusing time, composition of the binder resin and so forth.

With the volume-based median diameter ($d_{50}$) controlled in these ranges, it now becomes possible to precisely reproduce a very fine dot image with a resolution of 1200 dpi.

The volume-based median diameter ($d_{50}$) of the toner particle is measured and calculated using a measurement apparatus configured by connecting "Multisizer 3" (from Beckman Coulter Inc.) to a computer system installed with data processing software "Software V 3.51".

More specifically, a sample to be measured (toner) is added to, and mixed with a surfactant solution (a surfactant solution prepared typically by diluting 10-fold a neutral detergent containing a surfactant component with pure water, aimed at dispersing the toner particle), and the mixture is allowed to disperse by sonication to prepare a toner particle dispersion liquid. The toner particle dispersion liquid is pipetted into a beaker placed in a sample stand, which contains "ISOTON II" (from Beckman Coulter Inc.), until the concentration displayed on the measurement apparatus reaches 8%. With the concentration adjusted to this value, the obtained measurement values will be well reproducible. The number of particles to be measured and the aperture are set to 25000 and 100 μm, respectively, on the measurement apparatus. The measurement range from 2 to 60 μm is divided into 256 sections to calculate frequency values, wherein a 50% particle diameter counted down from the maximum volume-based cumulative median diameter is denoted as the volume-based median diameter ($d_{50}$).

<Average Circularity of Toner Particle>

The toner particle preferably has the average circularity in the range of 0.930 to 1.000, and more preferably in the range of 0.950 to 0.995, from the viewpoint of stability of charging susceptibility and low-temperature fixing property.

With the average circularity controlled in these ranges, each toner particle becomes less likely to be crushed, thereby making a frictional charging member less likely to be polluted, improving chargeability of the toner, and improving quality of the resultant image.

The average circularity of the toner particle is measured using "FPIA-2100" (from Sysmex Corporation).

In more detail, a sample to be measured (toner) is mixed with a surfactant solution, the mixture is allowed to disperse by sonication for one minute, and photographed under "FPIA-2100" (from Sysmex Corporation), while setting the measurement condition to the HPF (high power field) mode, at an appropriate concentration capable of yielding an HPF count of 3000 to 10000. Each toner particle is measured to find the circularity according to Formula (I) below, the circularity values of the individual toner particles are summed up, and the sum is then divided by the total number of toner particles. With the HPF count controlled in the above-described ranges, a good reproducibility may be obtained.

Circularity=(Circumferential length of circle having same projected area as particle image)/(Circumferential length of projected image of particle) Formula (I):

<Developer>

The electrostatic image developing toner of the present invention may be used as a magnetic or nonmagnetic single-component developer, or may be used as a two-component developer after being mixed with a carrier. For the carrier when the toner is used as the two-component developer, usable is any of magnetic particles composed of known magnetic materials including metal such as iron, ferrite and magnetite; and alloys composed of any of the above-described metals and any of other metals such as aluminum and lead. Ferrite particle is particularly preferable.

As the carrier, also usable is a coated carrier typically having a resin coating over the surface of a magnetic particle, or a dispersion carrier having a magnetic fine powder dispersed in a binder resin.

The carrier preferably has the volume-based median diameter ($d_{50}$) in the range of 20 to 100 μm, and more preferably in the range of 25 to 80 μm.

The volume-based media diameter ($d_{50}$) of the carrier may be measured typically by using a laser diffraction particle analyzer "HELOS" attached with a wet disperser (from Sympatec GmbH).

«Method of Manufacturing Electrostatic Image Developing Toner»

<Method of Manufacturing Toner Base Particle>

Method of manufacturing the toner base particle in the present invention is exemplified by suspension polymerization, emulsion aggregation, and other known methods, wherein emulsion aggregation is particularly preferable. According to the emulsion polymerization, the toner particle may be downsized easily, from the viewpoints of manufacturing cost and stability of manufacturing.

Manufacturing of the toner base particle by emulsion aggregation is a method of manufacturing the electrostatic image developing toner, which includes mixing a water-based dispersion, having the amorphous vinyl resin fine particle containing an optional releasing agent dispersed in a water-based medium, a water-based dispersion of the colorant fine particle, and a water-based dispersion of the crystalline polyester resin; and allowing the amorphous vinyl resin fine particle and the colorant fine particle and the crystalline polyester resin to aggregate to form the toner base particle.

The water-based dispersion is an article having a dispersate (particle) dispersed in a water-based medium, and the water-based medium is an article whose major component (50% by mass or more) is water. The component other than water is exemplified by water-soluble organic solvents which include methanol, ethanol, isopropanol, butanol, acetone, methyl ethyl ketone, and tetrahydrofuran. Alcoholic organic solvent such as methanol, ethanol, isopropanol and butanol are preferable among them, because they are incapable of dissolving the resin.

The amorphous vinyl resin fine particle may have a multi-layered structure composed of two or more layers having different resin compositions. The thus-configured amorphous vinyl resin fine particle, particularly a double-layered amorphous vinyl resin fine particle, may be obtained typically by preparing a dispersion liquid of the resin fine particle according to popular procedures of polymerization (first stage polymerization); adding a polymerization initiator and a polymerizable monomer to the dispersion liquid; and then subjecting the system to polymerization (second stage polymerization).

As one exemplary method of manufacturing the electrostatic image developing toner of the present invention, a method based on emulsion aggregation will be explained below.

(1) A step of manufacturing the amorphous vinyl resin fine particle, for manufacturing the amorphous vinyl resin fine particle containing the releasing agent.
(2) A step of manufacturing the crystalline polyester resin fine particle, which includes dissolving the crystalline polyester resin into an organic solvent, dispersing the mixture into a water-based dispersion medium to obtain an emulsion, and removing the organic solvent.
(3) A step of preparing a water-based dispersion of a colorant particle having dispersed therein the colorant fine particle into a water-based medium.
(4) A step of forming a core particle, which includes forming the core particle by allowing the amorphous vinyl resin fine particle, the colorant fine particle and the crystalline polyester resin fine particle to aggregate together in the water-based medium.
(5) A step of ripening, which includes ripening of the associated particle under heat energy to control the shape, and to obtain the toner base particle.
(6) A step of cooling, for cooling the dispersion liquid of the toner base particle.
(7) A step of filtration and rinsing, which includes separating the toner base particle from the water-based medium by filtration, and removing the surfactant and so forth from the toner base particle.
(8) A step of drying, for drying the rinsed toner base particle.
(9) A step of adding an external additive, for adding the external additive to the dried toner base particle.

(1) Step of Manufacturing Amorphous Vinyl Resin Fine Particle

In this step, a water-based dispersion of an amorphous vinyl resin fine particle is prepared.

The water-based dispersion of the amorphous vinyl resin fine particle may be prepared by mini-emulsion polymerization using a vinyl monomer for obtaining the amorphous vinyl resin.

For example, the vinyl monomer is added to the water-based medium which contains a surfactant, the mixture is allowed to form therein liquid droplet under mechanical energy applied thereto, and a polymerization reaction is allowed to proceed making use of a radical released from a water-soluble radical polymerization initiator. The liquid droplet may alternatively contain an oil-soluble polymerization initiator.

(Surfactant)

The surfactant used in this step may be any of known various types of surfactants such as anionic surfactant, cationic surfactant, and nonionic surfactant.

(Polymerization Initiator)

The polymerization initiator used in this step may be any of various types of known polymerization initiators.

As a specific example of the polymerization initiator, persulfate salt (potassium persulfate, ammonium persulfate, etc.) is preferably used. Alternatively, also azo-based compound (4,4'-azobis(4-cyanovaleric acid) and salt thereof, 2,2'-azobis(2-amidinopropane) salt, etc.), peroxide, azobis (isobutyronitrile) or the like may be used.

(Chain Transfer Agent)

In this step, a chain transfer agent, having been widely used, may be used to control the molecular weight of the amorphous vinyl resin. The chain transfer agent is exemplified by, but not specifically limited to, 2-chloroethanol; mercaptans such as octylmercaptan, dodecylmercaptan, and t-dodecylmercaptan, and styrene dimer.

The toner base particle in the present invention contains the releasing agent. The releasing agent may be introduced into the toner base particle, while being preliminarily dissolved or dispersed in a solution of monomer for forming the amorphous vinyl resin.

The toner base particle in the present invention may optionally contain other internal additive such as charge controlling agent. This sort of internal additive may be introduced into the toner base particle, while typically being dissolved or dispersed in a solution of monomer for forming the amorphous vinyl resin.

This sort of internal additive may be introduced into the toner base particle, alternatively by preparing a dispersion liquid of an internal additive fine particle solely composed of such internal additive, and then allowing the internal additive fine particle to aggregate in the core particle forming process, together with the amorphous vinyl resin fine particle, the colorant fine particle and the crystalline polyester resin fine particle. It is, however, preferable to incorporate the internal additive preliminarily in this process.

The average particle size of the amorphous vinyl resin fine particle is preferably in the range of 100 to 400 nm, in terms of volume-based median diameter ($d_{50}$).

In the present invention, the volume-based median diameter ($d_{50}$) of the styrene-acrylic resin fine particle is a value obtained by measurement using "Microtrac UPA-150" (from Nikkiso Co., Ltd.).

(2) Step of Manufacturing Crystalline Polyester Resin Fine Particle

In this step, a water-based dispersion of the crystalline polyester resin fine particle is prepared.

The water-based dispersion of the crystalline polyester resin fine particle may be prepared by synthesizing the crystalline polyester resin, and allowing the crystalline polyester resin to disperse in a water-based medium to obtain a particle dispersion. In more detail, for the preparation, the crystalline polyester resin is dissolved or dispersed in an organic solvent to prepare an oil-phase liquid, the oil-phase liquid is then allowed to disperse in the water-based medium typically by phase-transfer emulsification so as to form an oil droplet having a controlled particle size as desired, and the organic solvent is removed.

The used amount of the water-based medium is preferably in the range of 50 to 2000 parts by mass, and more preferably in the range of 100 to 1000 parts by mass, per 100 parts by mass of the oil-phase liquid.

The water-based medium may be added with a surfactant or the like, for the purpose of improving the dispersion stability of the oil droplet. Examples of the surfactant are same as those exemplified in the step described above.

The organic solvent used for preparing the oil-phase liquid is preferably any of those having low boiling point and low solubility to water, from the viewpoint of easiness of removal of the oil droplet after formed. Specific examples include methyl acetate, ethyl acetate, methyl ethyl ketone, methyl isobutyl ketone, toluene and xylene.

The organic solvent may be used alone or may be used in combination of two or more kinds.

The used amount of the organic solvent is typically in the range of 1 to 300 parts by mass, per 100 parts by mass of the crystalline polyester resin.

The oil-phase liquid may be emulsified and dispersed under mechanical energy.

The average particle size of the crystalline polyester resin fine particle is preferably in the range of 100 to 400 nm, in terms of volume-based median diameter ($d_{50}$).

In the present invention, the volume-based median diameter ($d_{50}$) of the crystalline polyester resin fine particle is a value obtained by measurement using "Microtrac UPA-150" (from Nikkiso Co., Ltd.).

(3) Step of Preparing Water-Based Dispersion of Colorant Fine Particle

This step is an optional step used when the toner base particle containing a colorant is desired, which includes allowing the colorant to disperse into a water-based medium to obtain a dispersion, to prepare a water-based dispersion of the colorant fine particle.

The water-based dispersion of the colorant fine particle is obtained by allowing the colorant to disperse in the water-based medium.

The colorant may be dispersed under mechanical energy, using a disperser not specifically limited, but preferably exemplified by pressure dispersers such as ultrasonic disperser, mechanical homogenizer, Manton-Gaulin homogenizer and pressure homogenizer; and medium-stirring type dispersers such as sand grinder, Getzmann mill, and diamond fine mill.

The colorant fine particle, as dispersed, preferably has the volume-based median diameter ($d_{50}$) in the range of 10 to 300 nm, more preferably in the range of 100 to 200 nm, and particularly preferably in the range of 100 to 150 nm.

In the present invention, the volume-based median diameter ($d_{50}$) of the colorant fine particle is a value obtained by measurement using an electrophoretic light scattering photometer "ELS-800" (from Otsuka Electronics Co., Ltd.).

(4) Step of Forming Core Particle

In this step, a core particle is formed by allowing the amorphous vinyl resin fine particle, the colorant fine particle, the crystalline polyester resin fine particle, and other optional toner-composing component(s) to aggregate.

In more detail, a water-based dispersion, having the individual fine particles described above dispersed in a water-based medium, is added with a coagulant at a concentration not lower than the critical aggregation concentration, and the mixture is heated to a temperature at or above the glass transition temperature (Tg) of the amorphous vinyl resin fine particle, so as to allow the fine particles to aggregate.

(Coagulant)

The coagulant preferably used in this step is selectable from, but not specifically limited to, metal salts such as alkali metal salts and alkali earth metal salts. The metal salt is exemplified by salts of monovalent metals such as sodium, potassium and lithium; salts of divalent metals such as calcium, magnesium, manganese and copper; and metals of trivalent metals such as iron and aluminum. Specific examples of the metal salts include sodium chloride, potassium chloride, lithium chloride, calcium chloride, magnesium chloride, zinc chloride, copper sulfate, magnesium sulfate, and manganese sulfate. Among them, the divalent metal salts are preferably used in particular, since only a small amount of them is enough to promote the aggregation.

The coagulant may be used alone or may be used in combination of two or more kinds.

(5) Step of Ripening

This step is an optional step. In this step of ripening, a ripening process is allowed to proceed so as to ripen the toner base particle, obtained in the step of forming core particle, under heat energy until a desired shape is obtained.

The ripening process is allowed to proceed specifically by stirring the system having the aggregated particle dispersed therein under heating, until a desired level of circularity of the aggregated particle will be obtained, while controlling the heating temperature, stirring speed, heating time and so forth.

(6) Step of Cooling

This step is conducted to cool the dispersion liquid of the toner base particle. Cooling conditions preferably include a cooling rate of 1 to 20° C./min. A specific method of cooling is exemplified by, but not specially limited to, a method of externally cooling a reaction vessel by introducing a coolant, and a method of cooling a reaction system by pouring cold water directly therein.

(7) Step of Filtration and Rinsing

The aim of this step is to conduct solid-liquid separation so as to separate the toner base particle from the thus-cooled dispersion liquid of the toner base particle, and to rinse a toner cake (a cake-like assembly of the toner base particle in a wet state), obtained by the solid-liquid separation, so as to remove any adherent such as surfactant, coagulant or the like.

Methods suitably used for the solid-liquid separation include, but not specially limited to, centrifugation, filtration under reduced pressure typically by using a nutsche filter, and filtration using a filter press. The rinsing is preferably continued until the conductance of the filtrate is reduced to 10 μS/cm.

(8) Step of Drying

This step is aimed to dry the rinsed toner cake, and may follow the step of drying in any known method of manufacturing the toner base particle having been widely practiced.

In more detail, examples of a dryer used for drying the toner cake include spray dryer, vacuum lyophilizer, and vacuum dryer. Preferably used is any of stationary rack dryer, travelling rack dryer, fluidized bed dryer, rotary dryer, and agitated dryer.

The dried toner base particle preferably has a moisture content of 5% by mass or less, and more preferably 2% by mass or less.

If the dried toner base particles mutually aggregate by a weak inter-particle attractive force, the aggregate may be crushed. Crusher usable herein includes mechanical crushers such as jet mill, Henschel mixer, coffee mill, and food processor.

(9) Step of Adding External Additive

This step is an optional step, necessary when an external additive is added to the toner base particle.

Although the toner base particle may be used without modification as the toner, the toner base particle may be used after being added with an external additive such as fluidizing agent, cleaning aid or the like, for the purpose of improving the fluidity, chargeability, and efficiency of cleaning.

Examples of apparatus usable for mixing the external additive include mechanical mixers such as Henschel mixer and coffee mill.

It is enough for the method of manufacturing the electrostatic image developing toner of the present invention to have at least the steps (1), (2) and (4), wherein the steps (3) and (5) to (9) are optional. When the step (3) is absent, the core particle is formed in step (4) by allowing the amorphous vinyl resin fine particle and the crystalline polyester resin fine particle to aggregate.

The toner base particle in the present invention may have a core-shell structure, although the toner base particle described above does not have such core-shell structure. For example, a step of forming a shell layer may follow the step (4) of forming the core particle. The shell layer in this case is preferably composed of an amorphous resin.

The crystalline resin dispersion liquid is preferably added in the early stage (heating process) of the step (4) of forming the core particle.

EXAMPLES

The present invention is detailed referring to, but is not limited to, preferred embodiments shown below.

In this Example, molecular weight distribution was measured by GPC, according to the procedures below:

The apparatus used here was "HLC-8220" (from Tosoh Corporation), and the column used here was "TSK guard column+TSKgel Super HZM-M, triple configuration" (from Tosoh Corporation). The column was kept at 40° C., and tetrahydrofuran (THF) was allowed to flow therethrough as a carrier solvent at a flow rate of 0.2 mL/min. A sample to be measured was dissolved into tetrahydrofuran at room temperature (25° C.) using a ultrasonic disperser for 5 minutes, so as to adjust the concentration to 1 mg/mL, the solution was filtered through a membrane filter having a pore size of 0.2 μm, 10 μL of the thus obtained sample solution was injected into the apparatus together with the carrier solvent described above. The sample was detected using a refractive index (RI) detector, and the molecular weight distribution of the sample to be measured was determined based on a standard curve obtained by using monodisperse standard polystyrene particles. The standard polystyrene samples used for obtaining the standard curve were those having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, all from Pressure Chemical Company. The standard curve was prepared by using at least such 10 species of standard polystyrene sample. An RI detector was used as the detector.

The ratio of content of the high molecular weight component (having a molecular weight of 100000 or more) was calculated as the ratio by area of the resin component having a molecular weight of 100000 or more, assuming the total area of peaks assignable to THF soluble moiety of the toner, in the gel permeation chromatogram which represents the molecular weight distribution obtained as described above.

The melting point ($T_{mc}$) of the crystalline polyester resin was determined by differential scanning calorimetry of the toner. A differential scanning calorimeter "Diamond DSC" (from PerkinElmer Inc.) was used for the differential scanning calorimetry. The measurement was conducted according to measurement procedures (heating/cooling conditions) including, in the following order, a first heating process involving heating at a heating rate of 10° C./min from room temperature (25° C.) up to 150° C., followed by isothermal holding at 150° C. for 5 minutes; a cooling process involving cooling at a cooling rate of 10° C./min from 150° C. down to 0° C., followed by isothermal holding at 0° C. for 5 minutes; and a second heating process involving heating at a heating rate of 10° C./min from 0° C. up to 150° C. In the measurement, 3.0 mg of the toner was placed in an aluminum pan, and the pan was set on a sample holder of differential scanning calorimeter "Diamond DSC". A vacant aluminum pan was used as the reference.

In the measurement, an endothermic curve obtained in the first heating process was analyzed to determine the melting point ($T_{mc}$) (° C.) of the crystalline polyester resin, based on the temperature at which the endothermic peak assignable to the crystalline polyester resin becomes deepest.

«Preparation of Dispersion Liquid of Releasing Agent Fine Particle»

<Preparation of Dispersion Liquid (W) of Releasing Agent Fine Particle>

A mixture of 450 parts by mass of behenyl behenate as the releasing agent, 50 parts by mass of sodium lauryl sulfate, and 3500 parts by mass of deionized water was heated to 80° C., thoroughly dispersed using Ultra-Turrax T50 from IKA, and further dispersed using a pressure-discharging Gaulin homogenizer, to thereby prepare a dispersion liquid (W) of releasing agent fine particle, having dispersed therein the releasing agent fine particle with a volume-based median diameter ($d_{50}$) of 180 nm.

«Preparation of Dispersion Liquid of Crystalline Polyester Resin Fine Particle»

<Synthesis of Crystalline Polyester Resin>

(1) Synthesis of Crystalline Polyester Resin (c1)

In a reaction vessel attached with a stirrer, a nitrogen gas introducing tube, a temperature sensor and a rectifying column, placed were 200 parts by mass of dodecane diacid and 102 parts by mass of 1,6-hexanediol, the reaction system was heated up to 190° C. over one hour. After confirming that the reaction system has been stirred uniformly, 0.3 parts by mass of $Ti(OBu)_4$ was added as a catalyst, the reaction system was further heated from 190° C. up to 240° C. over six hours, while eliminating the produced water, and kept at 240° C. so as to allow the dehydration polymerization reaction to continue for six hours, to obtain crystalline polyester resin (c1).

The thus-obtained crystalline polyester resin (c1) had a weight-average molecular weight (Mw) of 14500, and a melting point ($T_{mc}$) of 70° C.

(2) Synthesis of Hybrid Crystalline Polyester Resin (c2)

Source monomers of the addition polymerized resin (styrene-acrylic resin: StAc) unit, containing a monomer reactive with styrene and butyl acrylate, and a radical polymerization initiator, listed below, were placed in a dropping funnel.

| | |
|---|---|
| Styrene | 8.2 parts by mass |
| n-Butyl acrylate | 2.7 parts by mass |
| Acrylic acid | 0.5 parts by mass |
| Polymerization initiator (di-t-butyl peroxide) | 1.7 parts by mass |

On the other hand, source monomers of a polycondensed resin (crystalline polyester resin: CPEs) unit, listed below, were placed in a four-necked flask attached with a nitrogen gas introducing tube, a dehydration tube, a stirrer and a thermocouple, and the mixture was heated to 170° C. for dissolution.

| | |
|---|---|
| Dodecane diacid | 250 parts by mass |
| 1,6-Hexanediol | 128 parts by mass |

Next, the source monomers of the addition polymerized resin (StAc) were added dropwise under stirring over 90 minutes, the mixture was ripened for 60 minutes, and an unreacted portion of the addition polymerizable monomers were removed under reduced pressure (8 kPa). The amounts of removed monomers were very small, relative to the amounts of charge of the source monomers for composing the resin.

Thereafter, 0.8 parts by mass of $Ti(OBu)_4$ was added as an esterification catalyst, the mixture was heated to 235° C., and therein the reaction was allowed to proceed at normal pressure (101.3 kPa) for five hours, and further under reduced pressure (8 kPa) for one hour.

Next, the mixture was cooled down to 200° C., and therein the reaction was allowed to proceed under reduced pressure (20 kPa) for one hour, to thereby obtain hybrid crystalline polyester resin (c2).

The thus obtained hybrid crystalline polyester resin (c2) had a weight-average molecular weight (Mw) of 18900, and a melting point ($T_{mc}$) of 69° C.

(3) Synthesis of Hybrid Crystalline Polyester Resins (c3) to (c5)

Hybrid crystalline polyester resins (c3) to (c5) were synthesized in the same way as hybrid crystalline polyester resin (c2), except that the amount of the source monomers of the addition polymerized resin (styrene-acrylic resin: StAc) unit, and the amount of the radical polymerization initiator were modified as shown below.

Hybrid Crystalline Polyester Resin (c3)

| | |
|---|---|
| Styrene | 22.2 parts by mass |
| n-Butyl acrylate | 7.8 parts by mass |
| Acrylic acid | 1.3 parts by mass |
| Polymerization initiator (di-t-butyl peroxide) | 4.6 parts by mass |

Hybrid Crystalline Polyester Resin (c4)

| | |
|---|---|
| Styrene | 51.7 parts by mass |
| n-Butyl acrylate | 18.3 parts by mass |
| Acrylic acid | 3.0 parts by mass |
| Polymerization initiator (di-t-butyl peroxide) | 10.7 parts by mass |

Hybrid Crystalline Polyester Resin (c5)

| | |
|---|---|
| Styrene | 66.5 parts by mass |
| n-Butyl acrylate | 23.5 parts by mass |
| Acrylic acid | 3.9 parts by mass |
| Polymerization initiator (di-t-butyl peroxide) | 13.7 parts by mass |

The thus-obtained crystalline polyester resins (c3) to (c5) had weight-average molecular weights (Mw) of 24500, 35500 and 41500, respectively, and melting points ($T_{mc}$) of 68° C., 67° C. and 66° C., respectively.

(4) Synthesis of Hybrid Crystalline Polyester Resin (c6)

Source monomers of the addition polymerized resin (styrene-acrylic resin: StAc) unit, containing a monomer reactive with styrene and butyl acrylate, and a radical polymerization initiator, listed below, were placed in a dropping funnel.

| | |
|---|---|
| Styrene | 36.0 parts by mass |
| n-Butyl acrylate | 13.0 parts by mass |
| Acrylic acid | 2.0 parts by mass |
| Polymerization initiator (di-t-butyl peroxide) | 7.0 parts by mass |

On the other hand, source monomers of a polycondensed resin (crystalline polyester resin: CPEs) unit, listed below, were placed in a four-necked flask attached with a nitrogen gas introducing tube, a dehydration tube, a stirrer and a thermocouple, and the mixture was heated to 170° C. for dissolution.

Tetradecane diacid 440 parts by mass 1,4-Butanediol 153 parts by mass

Next, the source monomers of the addition polymerized resin (StAc) were added dropwise under stirring over 90 minutes, the mixture was ripened for 60 minutes, and an unreacted portion of the addition polymerizable monomers were removed under reduced pressure (8 kPa). The amounts of removed monomers were very small, relative to the amounts of charge of the source monomers for composing the resin.

Thereafter, 0.8 parts by mass of $Ti(OBu)_4$ was added as an esterification catalyst, the mixture was heated to 235° C., and therein the reaction was allowed to proceed at normal pressure (101.3 kPa) for five hours, and further under reduced pressure (8 kPa) for one hour.

Next, the mixture was cooled down to 200° C., and therein the reaction was allowed to proceed under reduced pressure (20 kPa) for one hour, to thereby obtain hybrid crystalline polyester resin (c6).

The thus obtained hybrid crystalline polyester resin (c6) had a weight-average molecular weight (Mw) of 24500, and a melting point ($T_{mc}$) of 75° C.

(5) Synthesis of Hybrid Crystalline Polyester Resin (c7)

In a reaction vessel attached with a stirrer, a nitrogen gas introducing pipe, a temperature sensor and a rectifying column, placed were 275 parts by mass of sebacic acid and 275 parts by mass of 1,12-dodecanediol, and the reaction system was heated up to 190° C. over one hour. After confirming that the reaction system has been stirred uniformly, 0.3 parts by mass of $Ti(OBu)_4$ was added as a catalyst, the reaction system was further heated from 190° C. up to 240° C. over six hours, while eliminating the produced water, and kept at 240° C. so as to allow the dehydration polymerization reaction to continue for six hours, to obtain crystalline polyester resin (c7'). The thus-obtained crystalline polyester resin (c7') was then transferred to a reaction tank attached with a condenser, a stirrer, and a nitrogen gas introducing tube, added thereto was 300 parts by mass of ethyl acetate and 44 parts by mass of hexamethylene diisocyante, and the mixture was then allowed to react under a nitrogen gas flow at 80° C. for five hours.

Next, ethyl acetate was evaporated off under reduced pressure (15 kPa), to obtain hybrid crystalline polyester resin (c7).

The thus-obtained hybrid crystalline polyester resin (c7) had a weight-average molecular weight (Mw) of 52000, and a melting point ($T_{mc}$) of 79° C.

(6) Synthesis of Hybrid Crystalline Polyester Resin (c8)

Source monomers of the addition polymerized resin (styrene-acrylic resin: StAc) unit, containing a monomer reactive with styrene and butyl acrylate, and a radical polymerization initiator, listed below, were placed in a dropping funnel.

| | |
|---|---|
| Styrene | 45.8 parts by mass |
| n-Butyl acrylate | 16.2 parts by mass |
| Acrylic acid | 2.7 parts by mass |
| Polymerization initiator (di-t-butyl peroxide) | 9.4 parts by mass |

On the other hand, source monomers of a polycondensed resin (crystalline polyester resin: CPEs) unit, listed below, were placed in a four-necked flask attached with a nitrogen gas introducing tube, a dehydration tube, a stirrer and a thermocouple, and the mixture was heated to 170° C. for dissolution.

| | |
|---|---|
| Adipic acid | 293 parts by mass |
| 1,6-Hexanediol | 237 parts by mass |

Next, the source monomers of the addition polymerized resin (StAc) were added dropwise under stirring over 90 minutes, the mixture was ripened for 60 minutes, and an unreacted portion of the addition polymerizable monomers were removed under reduced pressure (8 kPa). The amounts of removed monomers were very small, relative to the amounts of charge of the source monomers for composing the resin.

Thereafter, 0.8 parts by mass of $Ti(OBu)_4$ was added as an esterification catalyst, the mixture was heated to 235° C., and therein the reaction was allowed to proceed at normal pressure (101.3 kPa) for five hours, and further under reduced pressure (8 kPa) for one hour.

Next, the mixture was cooled down to 200° C., and therein the reaction was allowed to proceed under reduced pressure (20 kPa) for one hour, to thereby obtain hybrid crystalline polyester resin (c8).

The thus obtained hybrid crystalline polyester resin (c8) had a weight-average molecular weight (Mw) of 18000, and a melting point ($T_{mc}$) of 60° C.

(7) Synthesis of Crystalline Polyester Resin (c9)

In a reaction vessel attached with a stirrer, a nitrogen gas introducing pipe, a temperature sensor and a rectifying column, placed were 148 parts by mass of fumaric acid, 61 parts by mass of adipic acid, and 205 parts by mass of 1,6-hexanediol, the reaction system was heated up to 190° C. over one hour. After confirming that the reaction system has been stirred uniformly, 0.3 parts by mass of $Ti(OBu)_4$ was added as a catalyst, the reaction system was further heated from 190° C. up to 240° C. over six hours, while eliminating the produced water, and kept at 240° C. so as to allow the dehydration polymerization reaction to continue for six hours, to obtain crystalline polyester resin (c9).

The thus-obtained crystalline polyester resin (c9) had a weight-average molecular weight (Mw) of 20400, and a melting point ($T_{mc}$) of 90° C.

<Preparation of Dispersion Liquid of Crystalline Polyester Resin Fine Particle>

(1) Preparation of Dispersion Liquid (C1) of Crystalline Polyester Resin Fine Particle Seventy-two parts by mass of the thus-obtained polyester resin (c1) was added to 72 parts by mass of methyl ethyl ketone, and the mixture was stirred at 70° C. for 30 minutes for dissolution. Next, while keeping the solution stirred, 2.5 parts by mass of a 25% by mass aqueous sodium hydroxide solution was added. Next, an aqueous solution, prepared by dissolving sodium polyoxyethylene lauryl ether sulfate into 250 parts by mass of deionized water so as to adjust the concentration to 1% by mass, was added dropwise over 70 minutes.

Next, the emulsion kept at 70° C. was stirred for three hours at a reduced pressure of 15 kPa (150 mbar) using a diaphragm vacuum pump "V-700" (from BUCHI Labortechnik AG), to thereby evaporate off methyl ethyl ketone. Dispersion liquid (C1) of crystalline polyester resin fine particle, having the fine particle of crystalline polyester resin (c1) dispersed therein, was thus prepared.

The particle, contained in dispersion liquid (C1) of crystalline polyester resin fine particle, had a volume-average particle size of 132 nm, when measured using a laser diffraction particle analyzer "LA-750" (from HORIBA, Ltd.).

(2) Preparation of Dispersion Liquids (C2) to (C9) of Crystalline Polyester Resin Fine Particle Dispersion liquids (C2) to (C9) of crystalline polyester resin fine particle were prepared in the same way as in the preparation of dispersion liquid (C1) of crystalline polyester resin fine particle, except that crystalline polyester resin (c1) was replaced with hybrid crystalline polyester resins (c2) to (c8), and crystalline polyester resin (c9), respectively.

In Table 1, the number of carbon atoms C(acid) of dispersion liquid (C9) of crystalline polyester resin fine particle represents the number of carbon atoms of fumaric acid whose content (molar equivalent) is larger.

TABLE 1

| Dispersion liquid No. of crystalline polester resin particle | Crystalline polyester resin unit | | | Amorphous resin unit | | Weight-average molecular weight | Melting point (Tmc) [° C.] |
|---|---|---|---|---|---|---|---|
| | C(acid) | C(alcohol) | C(acid) − C(alcohol) | Resin species | Content [% by mass] | | |
| C1 | 12 | 6 | 6 | — | — | 14500 | 70 |
| C2 | 12 | 6 | 6 | Styrene-Acrylic resin | 3 | 18900 | 69 |
| C3 | 12 | 6 | 6 | Styrene-Acrylic resin | 8 | 24500 | 68 |
| C4 | 12 | 6 | 6 | Styrene-Acrylic resin | 17 | 35500 | 67 |
| C5 | 12 | 6 | 6 | Styrene-Acrylic resin | 21 | 41500 | 66 |
| C6 | 14 | 4 | 10 | Styrene-Acrylic resin | 8 | 24500 | 75 |
| C7 | 10 | 12 | −2 | Urethane resin | 8 | 52000 | 79 |
| C8 | 6 | 6 | 0 | Styrene-Acrylic resin | 12 | 18000 | 60 |
| C9 | 4 | 6 | −2 | — | — | 20400 | 90 |

«Preparation of Dispersion Liquid of Amorphous Resin Fine Particle»

<Preparation of Dispersion Liquid (A1) of Amorphous Vinyl Resin Fine Particle>

(1) First Stage Polymerization

In a 5 L reaction vessel attached with a stirrer, a temperature sensor, a condenser and a nitrogen introducing unit, placed were 5 parts by mass of sodium polyoxyethylene (2) dodecyl ether sulfate, and 3000 parts by mass of deionized water, and the inner temperature was elevated to 75° C., while stirring the content at a stirring rate of 230 rpm under a nitrogen gas flow.

After the temperature was elevated, a solution prepared by dissolving 3 parts by mass of potassium persulfate (KPS) into 100 parts by mass of deionized water was added, and the liquid temperature was adjusted to 75° C. A monomer mixture solution composed of 568 parts by mass of styrene (St), 164 parts by mass of n-butyl acrylate (BA) and 68 parts by mass of methacrylic acid (MAA) was added dropwise over one hour, and after completion of the dropwise addition, the content was stirred for three hours while being kept at 75° C. by heating, to thereby allow polymerization (first stage polymerization) to proceed. Dispersion liquid of resin fine particle (a1) was thus prepared.

(2) Second Stage Polymerization

In a 5 L reaction vessel attached with a stirrer, a temperature sensor, a condenser and a nitrogen introducing unit, placed was a solution prepared by dissolving 2 parts by mass of sodium polyoxyethylene (2) dodecyl ether sulfate into 3000 parts by mass of deionized water, and the content was heated to 70° C., further added with 72 parts by mass of dispersion liquid of resin fine particle (a1) in solid content equivalent, and with a monomer mixture solution prepared by dissolving, at 70° C., 100 parts by mass of behenyl behenate as a releasing agent, into a mixture solution composed of 201 parts by mass of styrene (St), 93 parts by mass of n-butyl acrylate (BA), 20 parts by mass of methacrylic acid (MAA) and 4.2 parts by mass of n-octylmercaptan. The mixture was mixed and dispersed for one hour using a mechanical disperser "Clearmix" (from M Technique Co., Ltd.) having a circulation path, to prepare a dispersion liquid containing an emulsified particle (oil droplet).

Next, to the dispersion liquid, added was an initiator solution prepared by dissolving 5 parts by mass of potassium persulfate (KPS) into 200 parts by mass of deionized water, the reaction system was then stirred for one hour while being kept at 75° C. by heating, to thereby allow polymerization (second stage polymerization) to proceed. Dispersion liquid of resin fine particle (a1') was thus prepared.

(3) Third Stage Polymerization

To the dispersion liquid of resin fine particle (a1'), added was an initiator solution prepared by dissolving 5 parts by mass of potassium persulfate (KPS) into 200 parts by mass of deionized water. Under a temperature condition of 80° C., a monomer mixture solution composed of 354 parts by mass of styrene (St), 126 parts by mass of n-butyl acrylate (BA), 33 parts by mass of methacrylic acid (MAA) and 8.4 parts by mass of n-octylmercaptan was added dropwise over one hour. After completion of the dropwise addition, the content was stirred for two hours under heating so as to allow polymerization (third stage polymerization) to proceed, and then cooled down to 28° C., to thereby prepare dispersion liquid (A1) of amorphous vinyl resin fine particle, having dispersed therein fine particle of amorphous resin (styrene-acrylic resin) with a volume-based median diameter ($d_{50}$) of 168 nm, and containing the releasing agent dispersed in the water-based medium.

<Preparation of Dispersion Liquid (A2) of Amorphous Vinyl Resin Fine Particle>

Dispersion liquid (A2) of amorphous vinyl resin fine particle was prepared in the same way as in the preparation of dispersion liquid (A1) of amorphous vinyl resin fine particle, except that the used amounts of dispersion liquid of resin fine particle (a1) and n-octylmercaptan in the second stage polymerization were 90 parts by mass in solid content equivalent, and 3.8 parts by mass, respectively; and that the monomer mixture solution in the third step polymerization contained 342 parts by mass of styrene (St), 121 parts by mass of n-butyl acrylate (BA), 32 parts by mass of methacrylic acid (MAA), and 8.1 parts by mass n-octylmercaptan.

<Preparation of Dispersion Liquid (A3) of Amorphous Vinyl Resin Fine Particle>

Dispersion liquid (A3) of amorphous vinyl resin particle was prepared in the same way as in the preparation of dispersion liquid (A1) of amorphous vinyl resin fine particle, except that dispersion liquid of resin fine particle (a3) was prepared by using 6 parts by mass of potassium persulfate (KPS) in the first stage polymerization; that 72 parts by mass (in solid content equivalent) of dispersion liquid of resin fine particle (a1) in the second stage polymerization was replaced with 45 parts by mass (in solid content equivalent) of dispersion liquid of resin fine particle (a3) and 4.7 parts by mass of n-octylmercaptan; and that the monomer mixture solution in the third stage polymerization contained 373 parts by mass of styrene (St), 132 parts by mass of n-butyl acrylate (BA), 35 parts by mass of methacrylic acid (MAA) and 8.8 parts by mass of n-octylmercaptan.

<Preparation of Dispersion Liquid (A4) of Amorphous Vinyl Resin Fine Particle>

Dispersion liquid (A4) of amorphous vinyl resin fine particle was prepared in the same way as in the preparation of dispersion liquid (A1) of amorphous vinyl resin fine particle, except that the used amounts of dispersion liquid of resin fine particle (a1) and n-octylmercaptan in the second stage polymerization were 108 parts by mass in solid content equivalent, and 2.5 parts by mass, respectively; and that the monomer mixture solution in the third step polymerization contained 329 parts by mass of styrene (St), 117 parts by mass of n-butyl acrylate (BA), 31 parts by mass of methacrylic acid (MAA), and 7.8 parts by mass of n-octylmercaptan.

<Preparation of Dispersion Liquid (A5) of Amorphous Vinyl Resin Fine Particle>

(1) First Stage Polymerization

In a 5 L reaction vessel attached with a stirrer, a temperature sensor, a condenser and a nitrogen introducing unit, placed was 5 parts by mass of sodium polyoxyethylene (2) dodecyl ether sulfate and 3000 parts by mass of deionized water, and the inner temperature was elevated to 80° C., while stirring the content at a stirring rate of 230 rpm under a nitrogen gas flow.

After the temperature was elevated, a solution prepared by dissolving 10 parts by mass of potassium persulfate (KPS) into 100 parts by mass of deionized water was added, and the liquid temperature was adjusted to 80° C. A monomer mixture solution composed of 568 parts by mass of styrene (St), 164 parts by mass of n-butyl acrylate (BA), 68 parts by mass of methacrylic acid (MAA), and 3.3 parts by mass of n-octylmercaptan was added dropwise over one hour, and after completion of the dropwise addition, the content was stirred for three hours while being kept at 80° C. by heating, to thereby allow polymerization (first stage polymerization) to proceed. Dispersion liquid of resin fine particle (a5) was thus prepared.

(2) Second Stage Polymerization

The second stage polymerization was carried out in the same way as in the preparation of dispersion liquid (A1) of amorphous vinyl resin fine particle, except that 72 parts by mass (in solid content equivalent) of dispersion liquid of resin fine particle (a1) in the second stage polymerization was replaced with 45 parts by mass (in solid content equivalent) of dispersion liquid of resin fine particle (a5) and 6.4 parts by mass of n-octylmercaptan.

(3) Third Stage Polymerization

Dispersion liquid (A5) of amorphous vinyl resin fine particle was prepared in the same was as in the preparation of dispersion liquid (A1) of amorphous vinyl resin fine particle, except that the monomer mixture solution in the third stage polymerization contained 373 parts by mass of styrene (St), 132 parts by mass of n-butyl acrylate (BA), 35 parts by mass of methacrylic acid (MAA), and 8.8 parts by mass of n-octylmercaptan.

<Preparation of Dispersion Liquid (A6) of Amorphous Polyester Resin Fine Particle>

(1) Preparation of Amorphous Polyester Resin (a6)

In a four-necked flask attached with a nitrogen gas introducing tube, a dehydration tube, a stirrer and a thermocouple, placed were 50 parts by mass of 2-mol ethylene oxide adduct of bisphenol-A (BPA-EO), 249 parts by mass of 2-mol propylene oxide adduct of bisphenol A (BPA-PO), 81 parts by mass of terephthalic acid (TPA), 36 parts by mass of fumaric acid (FA) and 2 parts by mass of esterification catalyst (tin octylate), therein a polycondensation reaction was allowed to proceed at 230° C. for 8 hours, and the content was then cooled down to 160° C. Thereafter, 30 parts by mass of trimellitic anhydride was added, therein a polycondensation reaction was allowed to proceed at 230° C. for three hours, and further allowed to react at 8 kPa for one hour, to obtain amorphous polyester resin (a6).

(2) Preparation of Dispersion Liquid (A6) of Amorphous Polyester Resin Fine Particle One hundred parts by mass of amorphous resin (a6) was crushed using "Roundel Mill Model RM" (from Tokuju Corporation), mixed with 638 parts by mass of a preliminarily prepared 0.26% by mass sodium lauryl sulfate solution, kept stirred, and the mixture was then allowed to disperse under ultrasonic energy using a ultrasonic homogenizer "US-150T" (from Nissei Corporation) at V-LEVEL of 300 μA for 60 minutes. Dispersion liquid (A6) of amorphous polyester resin fine particle, having dispersed therein the fine particle of amorphous polyester resin having a volume-based median diameter ($d_{50}$) of 160 nm, was thus prepared.

Table 2 below summarizes the weight-average molecular weight (Mw), and ratio by area of the resin components respectively having a molecular weight of 100000 or more and 300000 or more, of the thus manufactured amorphous resins, calculated from a chromatogram which represents the molecular weight distribution.

TABLE 2

| Dispersion liquid No. of amorphous resin particle | Resin species | Composition | Molecular weight distribution: Weight-average molecular weight (Mw) | Ratio by area [%]: Molecular weight ≥ 100000 | Ratio by area [%]: Molecular weight ≥ 300000 |
|---|---|---|---|---|---|
| A1 | Styrene-acrylic resin | St/BA/MAA | 77000 | 15.7 | 6.0 |
| A2 | Styrene-acrylic resin | St/BA/MAA | 89000 | 19.9 | 9.2 |
| A3 | Styrene-acrylic resin | St/BA/MAA | 51000 | 11.0 | 2.8 |
| A4 | Styrene-acrylic resin | St/BA/MAA | 110000 | 23.0 | 12.1 |
| A5 | Styrene-acrylic resin | St/BA/MAA | 45000 | 8.7 | 0.5 |
| A6 | Amorphous polyester resin | BPA-EO, BPA-PO/FA, TPA, TMA | 68000 | 12.2 | 3.1 |

«Preparation of Water-Based Dispersion of Colorant Particle»

<Preparation of Water-Based Dispersion (Bk) of Colorant Particle>

90 parts by mass of sodium dodecyl sulfate was added to 1600 parts by mass of deionized water. To the solution, 420 parts by mass of carbon black (Regal 330R, from Cabot Corporation) was added by small portions under sturring, and the mixture was allowed to disperse using a stirrer "Clearmix" (from M Technique Co., Ltd.), to thereby prepare water-based dispersion (Bk) of colorant fine particle.

The thus obtained water-based dispersion (Bk) had an average particle size (volume-based median diameter ($d_{50}$)) of colorant fine particle of 110 nm.

«Manufacture of Toner»

<Manufacture of Toner (1)>

In a reaction vessel attached with a stirrer, a temperature sensor and a condenser, placed were 210 parts by mass (in solid content equivalent) of water-based dispersion (A1) of amorphous vinyl resin fine particle, 184 parts by mass (in solid content equivalent) of water-based dispersion (A6) of amorphous polyester resin fine particle, 44 parts by mass (in solid content equivalent) of water-based dispersion (C1) of crystalline polyester resin fine particle, and 2000 parts by mass of deionized water, and the pH (25° C. equivalent) was adjusted to 10 using a 5 mol/L aqueous sodium hydroxide solution.

Thereafter, 43 parts by mass (in solid content equivalent) of water-based dispersion (Bk) of colorant particle was added, and an aqueous solution, prepared by dissolving 60 parts by mass of magnesium chloride into 60 parts by mass of deionized water, was added under stirring at 30° C. over 10 minutes. The content was allowed to stand for 3 minutes, and then heated up to 90° C. over 60 minutes, and kept at 90° C. so as to allow the growth reaction of particle to continue. The particle size of the associated particle was monitored in situ using "Coulter Multisizer 3" (from Beckman Coulter Inc.), and the particle growth was terminated when the volume-based median diameter ($d_{50}$) reached 6.1 μm, by adding an aqueous solution prepared by dissolving 100 parts by mass of sodium chloride into 450 parts by mass of deionized water. The content was kept stirred under heating at 90° C. so as to allow the particle to fuse, and upon the average circularity of toner particle reached 0.945, the content was cooled down to 30° C. at a cooling rate of 2.5° C./min. The average circularity of toner particle was measured using a measuring instrument "FPIA-2100" (from Sysmex Corporation), while setting the HPF count to 4000.

The content was then subjected to solid-liquid separation, the obtained dehydrated toner cake was re-dispersed into deionized water, and again subjected to solid-liquid separation. After repeating these processes three times, the cake was dried at 40° C. for 24 hours, to obtain a toner particle.

To 100 parts by mass of the thus obtained toner particle, 1.6 parts by mass of hydrophobic silica (number-average primary particle size=12 nm, hydrophobicity=68) and 0.6 parts by mass of hydrophobic titanium oxide (number-average primary particle size=20 nm, hydrophobicity=63) were added, and the content was mixed using "Henschel mixer" (from Mitsui Miike Machinery Co., Ltd.) at a peripheral rotor speed of 35 mm/sec for 20 minutes, to thereby obtain toner (1) having a volume-average particle size of 6.1 μm.

<Manufacture of Toners (2) to (8) and (10) to (15)>

Toners (2) to (8) and (10) to (15) were manufactured in the same way as in the manufacture of toner (1), except that the water-based dispersion of amorphous resin fine particle, and the water-based dispersion of crystalline polyester resin fine particle were altered as listed in Table 3.

<Manufacture of Toner (9)>

In a reaction vessel attached with a stirrer, a temperature sensor and a condenser, placed were 358 parts by mass (in solid content equivalent) of dispersion liquid (A6) of amorphous polyester resin fine particle, 44 parts by mass (in solid content equivalent) of water-based dispersion (C1) of crystalline polyester resin fine particle, 35 parts by mass (in solid content equivalent) of dispersion liquid (W) of releasing agent fine particle, and 2000 parts by mass of deionized water, and the pH (25° C. equivalent) was adjusted to 10 using a 5 mol/L aqueous sodium hydroxide solution.

Thereafter, 43 parts by mass (in solid content equivalent) of water-based dispersion (Bk) of colorant particle was added, and an aqueous solution, prepared by dissolving 60 parts by mass of magnesium chloride into 60 parts by mass of deionized water, was added under stirring at 30° C. over 10 minutes. The content was allowed to stand for 3 minutes, and then heated up to 85° C. over 60 minutes, and kept at 85° C. so as to allow the growth reaction of particle to continue. The particle size of the associated particle was monitored in situ using "Coulter Multisizer 3" (from Beckman Coulter Inc.), and the particle growth was terminated when the volume-based median diameter ($d_{50}$) reached 6.0 μm, by adding an aqueous solution prepared by dissolving 100 parts by mass of sodium chloride into 450 parts by mass of deionized water. The content was heated and kept stirred at 90° C. so as to allow the particle to fuse, and upon the average circularity of toner particle reached 0.945, the content was cooled down to 30° C. at a cooling rate of 2.5° C./min.

The content was then subjected to solid-liquid separation, the obtained dehydrated toner cake was re-dispersed into deionized water, and again subjected to solid-liquid separation. After repeating these processes three times, the cake was dried at 40° C. for 24 hours, to obtain a toner particle.

To 100 parts by mass of the thus obtained toner particle, 1.6 parts by mass of hydrophobic silica (number-average primary particle size=12 nm, hydrophobicity=68) and 0.6 parts by mass of hydrophobic titanium oxide (number-average primary particle size=20 nm, hydrophobicity=63) were added, and the content was mixed using "Henschel mixer" (from Mitsui Miike Machinery Co., Ltd.) at a peripheral rotor speed of 35 mm/sec for 20 minutes, to thereby obtain toner (9) having a volume-average particle size of 6.1 μm.

Table 3 below summarizes the weight-average molecular weight (Mw), and ratio by area of the resin components respectively having a molecular weight of 100000 or more and 300000 or more, of the thus manufactured toners, calculated from a chromatogram which represents the molecular weight distribution.

TABLE 3

| | Binder resin | | | | | | | | | | | |
|---|---|---|---|---|---|---|---|---|---|---|---|---|
| | Dispersion liquid of amorphous resin particle | | Dispersion liquid of crystalline polyester resin particle | | | | | | Molecular weight distribution | | | |
| | | | | | | | | | | Ratio by area [%] | | |
| Toner No. | Dispersion liquid No. | Content [parts by mass] | Dispersion liquid No. | Content [parts by mass] | Melting point (Tmc) [° C.] | *1 | *2 | *3 | *4 | Molecular weight ≥100000 | Molecular weight ≥300000 | Remarks |
| 1 | A1/A6 | 210/184 | C1 | 44 | 70 | 45.4 | 10.5 | 4.4 | 72400 | 12.5 | 3.5 | *5 |
| 2 | A1/A6 | 258/153 | C2 | 26 | 69 | 56.4 | 6.4 | 5.4 | 73000 | 14.5 | 4.8 | *5 |
| 3 | A1 | 393 | C2 | 44 | 69 | 89.0 | 11.0 | 8.2 | 73500 | 14.6 | 4.9 | *5 |
| 4 | A1 | 393 | C3 | 44 | 68 | 89.0 | 11.0 | 8.2 | 74200 | 15.2 | 5.2 | *5 |
| 5 | A3 | 393 | C4 | 44 | 67 | 89.0 | 11.0 | 8.2 | 50500 | 10.5 | 1.2 | *5 |
| 6 | A1 | 362 | C5 | 74 | 66 | 81.5 | 18.5 | 7.5 | 67100 | 12.2 | 3.2 | *5 |
| 7 | A1 | 384 | C6 | 52 | 75 | 86.8 | 13.2 | 8.0 | 76050 | 15.5 | 5.4 | *5 |
| 8 | A2 | 393 | C7 | 44 | 79 | 89.0 | 11.0 | 8.2 | 89500 | 19.2 | 7.8 | *5 |
| 9 | A6 | 358 | C1 | 44 | 70 | 0 | 10.9 | 7.3 | 67100 | 11.3 | 2.7 | *6 |
| 10 | A1 | 419 | C2 | 17 | 69 | 95.6 | 4.4 | 8.7 | 74500 | 14.8 | 5.7 | *6 |
| 11 | A1 | 349 | C2 | 87 | 69 | 78.3 | 21.7 | 7.3 | 59000 | 11.4 | 4.7 | *6 |
| 12 | A1 | 393 | C8 | 44 | 60 | 89.0 | 11.0 | 8.2 | 73500 | 14.5 | 5.5 | *6 |
| 13 | A1 | 393 | C9 | 44 | 90 | 89.0 | 11.0 | 8.2 | 76500 | 15.8 | 5.9 | *6 |

TABLE 3-continued

| | Binder resin | | | | | | | | | | | |
|---|---|---|---|---|---|---|---|---|---|---|---|---|
| | Dispersion liquid of amorphous resin particle | | Dispersion liquid of crystalline polyester resin particle | | | | | | Molecular weight distribution | | | |
| | | | | | | | | | | Ratio by area [%] | | |
| Toner No. | Dispersion liquid No. | Content [parts by mass] | Dispersion liquid No. | Content [parts by mass] | Melting point (Tmc) [° C.] | *1 | *2 | *3 | *4 | Molecular weight ≥100000 | Molecular weight ≥300000 | Remarks |
| 14 | A4 | 393 | C2 | 44 | 69 | 89.0 | 11.0 | 8.2 | 93000 | 21.2 | 11.8 | *6 |
| 15 | A5 | 393 | C2 | 44 | 69 | 89.0 | 11.0 | 8.2 | 44500 | 8.5 | 0.3 | *6 |

*1: Ratio of content of vinyl resin [% by mass]
*2: Ratio of content of crystalline polyester resin [% by mass]
*3: Ratio of content of mold releasing agent [% by mass]
*4: Weight-average molecularweight (Mw)
*5: Present invention
*6: Comparative example «Manufacture of Developer»

Developers (1) to (15) were manufactured by adding a ferrite carrier, having a silicone resin coating and a volume-average particle size of 60 μm to toners (1) to (15), respectively, so as to adjust the toner particle concentration to 6% by mass.

«Evaluation»

<Low-Temperature Fixing Property>

Each of developers (1) to (15) was loaded on a copying machine "bizhub PRO (registered trademark) C6501" (from Konica Minolta, Inc.), whose fixing device has been modified so that the surface temperature of a heat roller for fixing would be variable in the range of 100 to 200° C. Fixation test, by which a solid image with an amount of toner deposition of 11 mg/10 $cm^2$ is fixed on A4 plain paper (grammage=80 $g/m^2$), was repeated while varying the preset fixation temperature at 5° C. intervals from 85° C. up to 200° C.

Next, a printed matter obtained in the fixation test at each fixation temperature was folded using a folding machine, so as to apply load on the solid image, compressed air of 0.35 MPa was blown thereto, and the crease was rated on a five-rank scale with the evaluation criteria given below.

Rank 5: No peel-off is observed at the crease.

Rank 4: A partial peel-off is found along the crease.

Rank 3: A narrow linear peel-off is found along the crease.

Rank 2: A bold linear peel-off is found along the crease.

Rank 1: A large peel-off is found in the image.

Among the fixing tests having acquired Rank 3, the lowest fixing temperature in the fixing tests was taken as the lowest fixing temperature. And it was evaluated according to the following criteria. The evaluation classes of A, B and C were in the category of passing the test.

The evaluation results are listed in Table 4.

A: The lowest fixing temperature is not more than 150° C.

B: The lowest fixing temperature is larger than 150° C. and not more than 160° C.

C: The lowest fixing temperature is larger than 160° C. and not more than 180° C.

D: The lowest fixing temperature is larger than 180° C.

<Storage Performance under Heating>

0.5 g of toner was put into a 10 mL glass vial having an inner diameter of 21 mm, the vial was capped, agitated 600 times on Tap Denser KYT-2000 (from Seishin Enterprise Co., Ltd.) at room temperature (25° C.), uncapped, and allowed to stand in an environment of 55° C., 35% RH for two hours. The toner was placed carefully on a 48-mesh (opening=350 μm) screen so as not to disaggregate the toner aggregate, the screen was set on a powder tester (from Hosokawa Micron Corporation), fixed using a presser bar and a knobbed nut, and agitated for 10 seconds while setting the agitation intensity to a feed pitch of 1 mm. The toner aggregation (% by mass) was calculated based on the amount of residual toner remained on the screen.

The toner aggregation was calculated by the equation below:

$$\text{Toner aggregation (\%)} = (\text{Mass of toner remained on screen (g)}/0.5\ \text{(g)}) \times 100$$

The toner aggregation was evaluated according to the criteria below, to give indices for storage performance of toner under heating. The evaluation classes of A, B and C were in the category of passing the test.

Results of evaluation are summarized in Table 4.

A: toner aggregation is less than 10% by mass (excellent storage performance of toner under heating)

B: toner aggregation is 10% by mass or more and less than 15% by mass (good storage performance of toner under heating)

C: toner aggregation is 15% by mass or more and less than 20% by mass (good storage performance of toner under heating)

D: toner aggregation is more than 20% by mass (poor storage performance of toner under heating, unusable)

<Glossiness>

Each of developers (1) to (15) was loaded on a commercially available all-in-one printer "bishub PRO C6501" (from Konica Minolta, Inc.), the surface temperature of a heating member of a fixing device based on the heat roller fixing system was set to 180° C., and image was formed in an environment under normal temperature and normal humidity (20° C., 50% RH), on "POD 128 g gloss coat (128 $g/m^2$)" (from Oji Paper Co., Ltd.). The glossiness of a solid image, when the amount of toner on a transfer paper was set to 1.2 $mg/cm^2$, was measured. An acceptable range of glossiness is 17% or below.

Results of evaluation are summarized in Table 4.

The glossiness was measured using "Gloss Meter" (from Murakami Color Research Laboratory Co., Ltd.), at an angle of incidence of 75°, with reference to the surface of a glass having a refractive index of 1.567.

<Long-Term Image Stability>

After continuously printing one hundred thousand sheets of character image, at a coverage rate of 10%, under an environment with high temperature and high humidity (30°

C., 85% RH), a test image containing a solid image and a halftone image was printed. The image density and white streak were observed, and evaluated according to the criteria below. Those assigned with A and B are acceptable.

Results of evaluation are summarized in Table 4.

A: No visible degradation in image density or white streak.

B: Slight (but practically acceptable level of) visible degradation in image density and/or white streak.

C: Visible degradation in image density and fogging.

TABLE 4

| Toner No. | Low temperature fixability: Lowest fixation temperature (° C.) | Low temperature fixability: Rank | Shelf stability under heating | Glossiness (%) | Long-term image stability | Remarks |
|---|---|---|---|---|---|---|
| 1 | 180 | C | C | 17 | B | Present invention |
| 2 | 170 | C | B | 15 | A | Present invention |
| 3 | 160 | B | A | 13 | B | Present invention |
| 4 | 140 | A | A | 11 | A | Present invention |
| 5 | 155 | B | C | 17 | A | Present invention |
| 6 | 155 | A | B | 13 | B | Present invention |
| 7 | 140 | A | A | 12 | A | Present invention |
| 8 | 165 | C | A | 9 | B | Present invention |
| 9 | 165 | B | D | 21 | C | Comparative example |
| 10 | 190 | D | B | 15 | B | Comparative example |
| 11 | 150 | A | D | 18 | C | Comparative example |
| 12 | 140 | A | D | 28 | C | Comparative example |
| 13 | 190 | D | B | 13 | B | Comparative example |
| 14 | 190 | D | A | 9 | B | Comparative example |
| 15 | 155 | B | B | 25 | C | Comparative example |

As is clear from Table 4, the toners of the present invention are excellent in the low-temperature fixing property, storage performance under heating, glossiness and long-term image stability as compared with the toners of Comparative examples.

From these results, it was confirmed that the toner having the following features is effective to provide an electrostatic image developing toner which is excellent in the low-temperature fixing property and low glossiness, further in the storage performance under heating, and capable of forming high-quality image over a long term. The features include that the toner has a weight-average molecular weight in the range of 50000 to 90000, when calculated from a chromatogram which represents the molecular weight distribution and is measured by gel permeation chromatography; that the ratio of content of a resin component having a molecular weight of 100000 or more is in the range of 10 to 20% by area in the chromatogram which represents the molecular weight; that the crystalline polyester resin has a melting point in the range of 65 to 85° C.; and that the ratio of content of the crystalline polyester resin in the binder resin is in the range of 5 to 20% by mass.

What is claimed is:

1. An electrostatic image developing toner comprising a toner base particle containing a binder resin and a releasing agent, wherein the binder resin comprises an amorphous vinyl resin and a crystalline polyester resin;

a weight-average molecular weight of the electrostatic image developing toner is in the range of 50000 to 90000, when calculated from a chromatogram which represents a molecular weight distribution and is measured by gel permeation chromatography;

a ratio of content of a resin component having a molecular weight of 100000 or more is in the range of 10 to 20% by area, and a ratio of content of a resin component having a molecular weight of 300000 or more is in the range of 1.2 to 9% by area, in the chromatogram which represents the molecular weight distribution of the toner;

the crystalline polyester resin has a melting point in the range of 65 to 85° C.; and, a ratio of content of the crystalline polyester resin in the binder resin is in the range of 5 to 20% by mass.

2. The electrostatic image developing toner of claim 1, wherein a ratio of content of the amorphous vinyl resin in the binder is 50% by mass or more.

3. The electrostatic image developing toner of claim 1, wherein the crystalline polyester resin is a single polymer synthesized by a polycondensation reaction between a polyhydric alcohol component and a polycarboxylic acid component.

4. The electrostatic image developing toner of claim 1, wherein the crystalline polyester resin is a hybrid crystalline polyester resin having copolymerized therein a crystalline polyester resin unit synthesized by a polycondensation reaction between a polyhydric alcohol component and a polycarboxylic acid component, and an amorphous resin unit other than polyester resin.

5. The electrostatic image developing toner of claim 4, wherein the amorphous resin unit is a vinyl resin unit.

6. The electrostatic image developing toner of claim 4, wherein the ratio of content of the amorphous resin unit in the hybrid crystalline polyester resin is in the range of 5 to 20% by mass.

7. The electrostatic image developing toner of claim 3, wherein the number of carbon atoms of the polyhydric alcohol component (C(alcohol)) and the number of carbon atoms of the polycarboxylic acid component C(acid)) satisfy relations represented by Expressions (1) to (3) below:

$$C(acid)-C(alcohol)\geq 4 \quad \text{Expression (1)}$$

$$C(acid)\geq 10 \quad \text{Expression (2)}$$

$$C(alcohol)\leq 6 \quad \text{Expression (3).}$$

8. The electrostatic image developing toner of claim 7, wherein the number of carbon atoms of the polyhydric alcohol component (C(alcohol)) and the number of carbon atoms of the polycarboxylic acid component (C(acid)) satisfy a relation represented by Expression (4) below:

$$C(acid)-C(alcohol)\geq 6 \qquad \text{Expression (4).}$$

9. The electrostatic image developing toner of claim 1, wherein a weight-average molecular weight of the crystalline polyester resin is in the range of 15000 to 40000, when calculated from a chromatogram which represents a molecular weight distribution and is measured by gel permeation chromatography.

10. The electrostatic image developing toner of claim 3, wherein the polycarboxylic acid component is dodecane diacid and the polyhydric alcohol component is 1,6-hexanediol.

11. The electrostatic image developing toner of claim 1, wherein the amorphous vinyl resin is formed from a monomer composition including an acrylic ester-based monomer.

* * * * *